US005271337A

United States Patent [19]

Kolvites et al.

[11] Patent Number: 5,271,337

[45] Date of Patent: Dec. 21, 1993

[54] PLASTIC FRAME SYSTEM HAVING A TRIANGULAR SUPPORT POST

[75] Inventors: Albert Kolvites, Mountaintop; Robert J. Cohn, Dallas; John H. Welsch, Moscow; Willard J. Sickles, Dalton, all of Pa.; David T. Balazek, Clearwater, Fla.; Rodney E. Brancher, Exton, Pa.

[73] Assignee: Metro Industries Inc., Reno, Nev.

[21] Appl. No.: 987,052

[22] Filed: Dec. 7, 1992

Related U.S. Application Data

[60] Continuation of Ser. No. 541,531, Jun. 21, 1990, abandoned, which is a division of Ser. No. 299,557, Jan. 17, 1989, Pat. No. 4,964,350, which is a continuation-in-part of Ser. No. 77,645, Jul. 24, 1987, Pat. No. 4,811,670.

[51] Int. Cl.[5] ..... A47B 9/08

[52] U.S. Cl. ..... 108/107; 108/111; 108/144

[58] Field of Search ..... 108/111, 107, 144, 110; 211/153, 187, 190, 208

[56] References Cited

U.S. PATENT DOCUMENTS

| | | | |
|---|---|---|---|
| 3,255,722 | 6/1966 | Ferdinand et al. | 108/107 X |
| 3,332,374 | 7/1967 | Ferdinand et al. | 108/107 |
| 4,230,052 | 10/1980 | Champagne | 108/107 X |
| 4,637,323 | 1/1987 | Nicely | 108/111 X |
| 4,706,576 | 11/1987 | James | 108/107 X |
| 4,750,626 | 6/1988 | Nicely | 211/187 |
| 4,757,769 | 7/1988 | Suttles | 108/111 |
| 4,796,541 | 1/1989 | Halstrick | 108/111 |
| 4,811,670 | 3/1989 | Kolvites et al. | 108/107 |
| 4,815,394 | 3/1989 | Ettlinger et al. | 108/111 |
| 4,843,975 | 7/1989 | Welsch et al. | 108/111 X |
| 4,964,350 | 10/1990 | Kolvites et al. | 108/107 X |

*Primary Examiner*—Jose V. Chen

*Attorney, Agent, or Firm*—Fitzpatrick, Cella, Harper & Scinto

[57] ABSTRACT

A modular "knock-down" type shelving system having adjustable height shelves includes a plastic support post having a generally right equilateral triangular cross-section. The support post is composed of pultruded thermosetting plastic having unidirectional E Glass fibers extending therethrough and a thermoplastic coating bonded to the outer surface thereof. The inner surface of the interior side of the support post is bowed outwardly. As a result, when a wedge member is disposed on the interior side of the post and the support post and wedge member combination supports by wedge action a sleeve comprising an end beam and a collar, the interior side of the support post is urged outwardly and is supported by the wedge member. The collar is locked to the end beam when a tongue of the collar passes through a slot in the end beam into a rotatable lock in a blind hole in the bottom of the end beam. A plurality of shelves are adapted to be snap-fit over a rectangular support structure comprising two end beams, and two side beams and a center beam connecting the two end beams. In this manner the shelf can be easily assembled and disassembled and supported on a support post at a predetermined height.

65 Claims, 13 Drawing Sheets

FIG. 27.
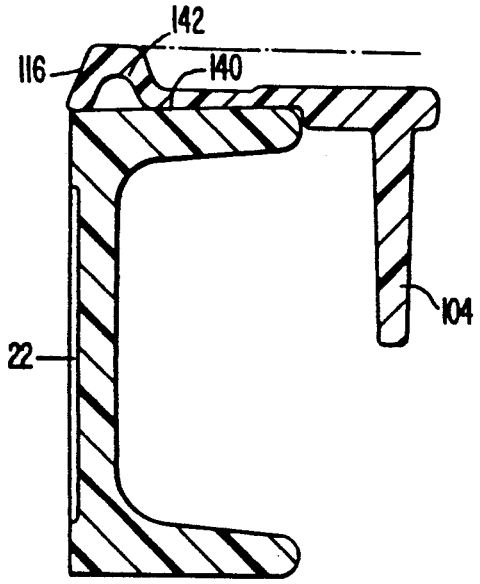
FIG. 28.
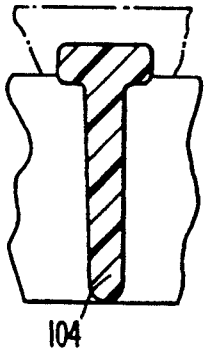
FIG. 29.
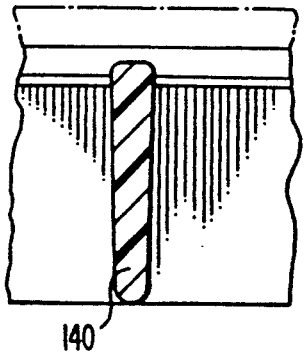
FIG. 30.
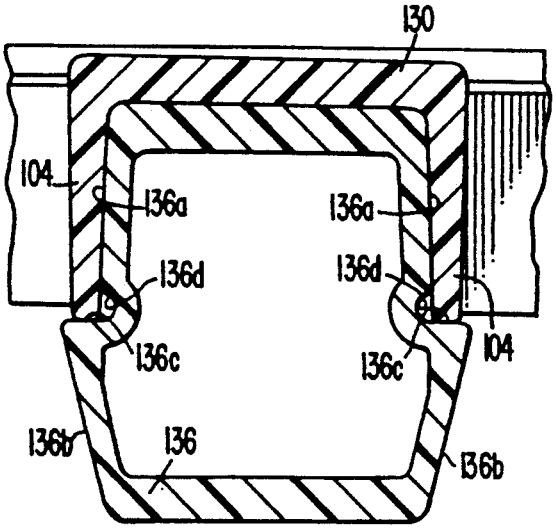
FIG. 31.
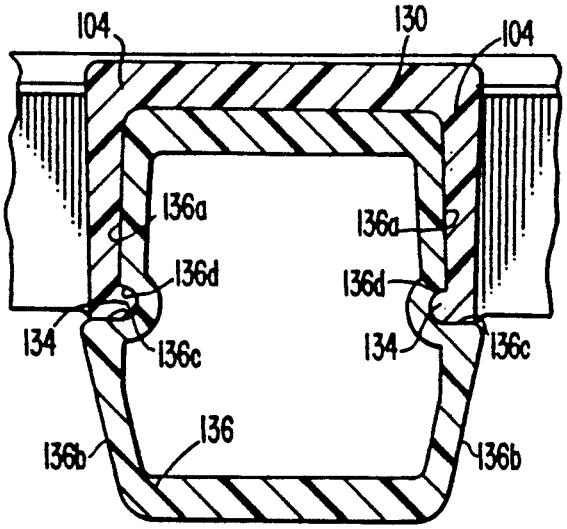
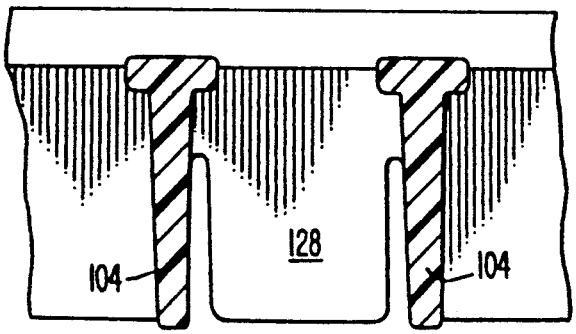
FIG. 32.

PLASTIC FRAME SYSTEM HAVING A TRIANGULAR SUPPORT POST

This application is a continuation of application Ser. No. 07/541,531 filed Jun. 21, 1990 now abandoned which is a division of application Ser. No. 07/299,557 filed Jan. 17, 1989, now U.S. Pat. No. 4,964,350 which was a continuation-in-part of application Ser. No. 07/077,645 filed Jul. 24, 1987, and issued as U.S. Pat. No. 4,811,670, Mar. 24, 1989.

BACKGROUND OF THE INVENTION

Field of the Invention

The present invention relates generally to a plastic "knock-down" frame system that can be used to support shelving and other elements for carrying any desired item. More particularly this shelving system and more generally frame system, is of the type having modular components that can be easily assembled and disassembled for shipment, storage, and cleaning, and for modification of the configuration of a specific shelf or other item-supporting structure.

The frame system of the present invention may advantageously be used in food service, industrial, commercial, hospital, and similar fields for storage of any desired items.

DESCRIPTION OF PERTINENT INFORMATION

Shelving systems having adjustable height shelves and so-called "knock-down" type shelving systems are known, and each has utility in many applications. Further, knock-down type shelving systems which also have adjustable height shelves have great utility in a number of applications, including the food service industry. For example, such shelving systems may be used for efficiently storing and transporting a wide variety of food items having various sizes, shapes and weights.

Generally speaking, in many such applications it is desirable to make the shelving system components of materials that do not corrode. It is also desirable to design such systems with a minimum number of crevices or other areas that might entrap contaminants. The systems should be designed for easy and effective cleaning.

Examples of "knock-down" type shelving systems which also have adjustable height shelves are shown in U.S. Pat. No. Re. 28,293; and U.S. Pat. Nos. 3,523,508; 3,874,511; 4,138,953; and 3,604,369. These systems use a support post having a polygonal or circular cross-section, and at least one shelf having corner assemblies in which a complementary bore or hole is formed therethrough for receiving the support post. A wedge member is then disposed on each support post, between the support post and the respective sleeve of the corner assembly, for providing shelf support at a predetermined height on the post by a wedging action therebetween.

Although each of these systems has great utility in many applications, each suffers a drawback in that the shelf support system does not allow for the insertion or removal of an interior shelf within a plurality of shelves without the removal of adjacent shelves and at least partial disassembly of the overall shelving system. Further, as the corner assemblies of each shelf are designed with a sleeve therethrough for reception of the support posts, a tradeoff occurs between available shelf space and the stability of the shelving system. In a "cylindrical post" type support system (shown for example in U.S. Pat. Nos. 3,523,508; 3,874,511; and 4,138,953), a certain amount of shelf space is sacrificed by enlarging the circular diameter of the sleeve and post by moving the hole inwardly to assure the stability of the shelving system. In a "square-hole" type support system shown U.S. Pat. No. Re. 28,293, shelf space is sacrificed due to the geometry of the support post, which extends into the interior of the shelf.

In an attempt to solve one problem characteristic of systems such as those described above, shelving systems in which an interior shelf may be added or removed have been proposed. For example, U.S. Pat. Nos. 4,637,323; 4,615,278; 4,582,001; and 4,079,678 all relate to such systems which incorporate corner posts and cooperating shelves. Each shelf has a corner structure that engages a portion of the outer peripheral surfaces of a corner post and interengages with an element that embraces the remainder of the outer peripheral surface of the post in the region of the shelf. These systems are all characterized by difficult assembly since it is inherently difficult to align each of the embracing elements with each of the corner posts and shelf, and to connect all three components together at the same time.

As a result, as described in U.S. patent application Ser. No. 077,645 filed Jul. 24, 1987, and issued as U.S. Pat. No. 4,811,670, Mar. 24, 1989, the assignee of the present invention had developed an improved knock-down type shelving system in which the shelves may be easily adjusted to different heights, and wherein an interior shelf may be inserted or removed from the shelving system without removing adjacent shelves or at least partially disassembling the overall shelving system. The shelf support system disclosed in this application includes a support post having a generally right equilateral triangular cross-section. The right angular apex faces the exterior of the shelving system and the adjacent flat exterior sides of each support post are arranged parallel to the sides of the shelf, thus providing multi-directional stability for the assembly, particularly in the directions of the stress forces parallel to the sides of the shelf. A plastic wedge member is molded with contoured lips for embracing the interior face of the support post with a clip-on operation. The wedge member includes a viewing window, a shelf height indicator, and detent tabs, which, in cooperation with detent steps provided on the interior face of the support posts, adjustably locate the wedge member on the support post at a desired position. A bendable collar detachably engages a tapered corner bracket structurally associated with each corner of the shelf, and together therewith forms a sleeve around each support post, such that when the collar and corner bracket assembly is moved down the support post to seat on the wedge member, it securely and stably supports the shelf at the predetermined position on the support post by wedging action.

While the system of U.S. Pat. No. 4,811,670 represents a substantial advance in the shelving art, still further improvements described below are desirable.

SUMMARY OF THE INVENTION

For purposes of explanation, the present invention will be described with reference to a shelving system. However, it in broadest aspect, this invention relates a frame system that can support shelves, and as described below in greater detail, other elements for carrying a wide variety of items. For example, this frame system can support combinations of shelving, drawers, work surfaces, racks, bins, and the like.

Accordingly, it is an object of the present invention to mitigate the disadvantages of the prior art.

It is another object of the present invention to provide a frame or shelving system that will not corrode and which minimizes the number of concealed areas in order to permit easy and effective cleaning.

It is another object of the present invention to provide a shelving system which is lighter in weight than conventional metal shelving systems but which can nevertheless support a heavy load.

It is still another object of the present invention to provide a shelving system having shelves that can be easily made in a variety of lengths for a variety of applications.

It is a further object of the present invention to provide a non-corrosive shelving or frame system having support posts which can accommodate a heavy load without buckling.

It is still a further object of the present invention to provide a knock-down type shelving system which permits insertion and removal of an interior shelf without removing adjacent shelves, or at least partially disassembling the overall shelving system.

Another object of the present invention is to provide a system having support surfaces that can easily be removed for easy and effective cleaning.

It is yet another object of the present invention to provide an improved knock-down type shelf support system of simple design, requiring no tools to assemble, to insert or remove interior shelves, or to adjust the height of the shelves.

It is another object of the present invention to provide an improved knock-down type shelving system which efficiently maximizes available shelf space in a stable design.

In accordance with the preferred embodiment, the frame or shelving system of the present invention incorporates a support post having a generally triangular cross-section for efficiently maximizing the available shelf space while providing multi-directional structural stability. The inner face of the interior side of the support post is bowed outwardly. As a result, when a load is placed on the support post the interior side bows further outwardly against a snap-on wedge member attached to the interior side of the support posts, thereby supporting the interior side. The wedge member has detent means which cooperate with the support posts, to locate adjustably the wedge member at a predetermined height thereon. A pair of sleeves for two post and wedge members is formed by two collars and an end beam, having corners, on which the shelves are supported. Two tongues of each collar are inserted through two slots of the end beam into two blind holes of the end beam and are engaged by a rotatable lock in the blind holes that locks the collar to the beam. The sleeve has a shape complementary to the shape of the post and wedge and has a size sufficient to be seated on the post and wedge by wedging action of the wedge.

Two end beams are connected by two side beams to form a rectangular frame and a center beam may be inserted between the end beams, parallel to the side beams, to increase the load bearing capability of the system. A plurality of shelf mats are adapted to be snap-fit onto the frame. The end, side, and center beams stably support the shelf mats, and the removable sleeve about the support posts stably locates and supports each shelf corner at a predetermined height by wedging action between the sleeve, wedge, and post. This structure permits the insertion or removal of an assembled shelf located in the interior of the shelving system without removing adjacent shelves or partially disassembling the shelving system.

More particularly, two end beams are connected by the two side beams to form a rectangular frame for supporting shelf mats of the shelving system. Each end beam is a plastic unitary body having a generally C-shaped configuration in plan view formed with two corner portions each having two spaced blind holes and two spaced slots therein. Each slot opens onto an exterior surface of the end beam and opens into a different blind hole. Each slot is also adapted to receive a tongue of a collar inserted therein whereby a sleeve for a support post is formed by the collar and the end beam. This sleeve is adapted to be fixed upon the support post by wedging action with the wedge positioned on the support post when the support post is displaced through the sleeve.

A lock is formed to be received in and rotated in each blind hole, between locked and unlocked positions, for locking and unlocking the tongue of the collar passing into each slot. Each tongue of the collar has an opening therein which receives a tongue of the lock when the lock is rotated to its locked position.

The two spaced end beams form four corners of the shelving system. Shelf mats are fitted over the two end beams, and are friction or snap-fit over the side beams and the center beam. Each shelf mat comprises a plurality of ribs projecting downwardly from an upper support surface thereof and spaced from the outer edge of the shelf. The plurality of ribs comprise an outer peripheral wall facing the outer edge of the shelf mat. Each mat also comprises an outer web formed between the outer peripheral wall of the plurality of ribs and the outer edge of the mat. Also provided is a flange projecting downwardly from the outer edge of the upper support surface. The flange, the outer web, and the outer peripheral wall together may comprise an outer channel or flange for receiving the upper surface of the end beam and the side beams therein. Lugs extending from the outer peripheral wall toward the flange permit a friction fit of the mats between the side beams.

The support post is hollow and has a generally right triangular cross-section. As a result, the support post has two exterior sides, and an interior side longer than the exterior sides, with the right angular apex being an exterior apex facing the exterior of the shelving system. The inner surface of the interior side of the support post is curved outwardly. That is, the inner surface of the post is urged in the outward direction against the wedge members attached to the interior side of the support post in response to the weight of the shelf being communicated to the post by the wedging action of the wedge.

The support post may be made of a thermosetting plastic body having a thermoplastic coating bonded to the exterior surface thereof. The thermoplastic coating on the interior face of the support post has a plurality of detent steps formed therein. Each detent step has a depth less than the depth of the thermoplastic coating.

A more complete appreciation along with an understanding of other objects, features, and advantages of the present invention will become apparent from the following detailed description, when considered in conjunction with the accompanying drawing.

BRIEF DESCRIPTION OF THE DRAWING

FIG. 27 is a fragmentary cross-sectional view of a portion of the mat and end beam taken along plane 27—27 in FIG. 19;

FIG. 28 is a fragmentary cross-sectional view of a rib of the mat of the present invention taken along plane 28—28 in FIG. 19;

FIG. 29 is a fragmentary cross-sectional view of a rib of the mat of the present invention taken along plane 29—29 in FIG. 19;

FIG. 30 is a fragmentary enlarged view of channel 132 illustrated in FIG. 20 in combination with a center beam being held therein;

FIG. 31 is a fragmentary enlarged view of channel 132 of FIG. 22 in combination with a center beam being held therein;

FIG. 32 is a cross-sectional view of the ribs of the mat taken along plane 32—32 of FIG. 19;

DETAILED DESCRIPTION OF PREFERRED EMBODIMENTS

Figure 1:
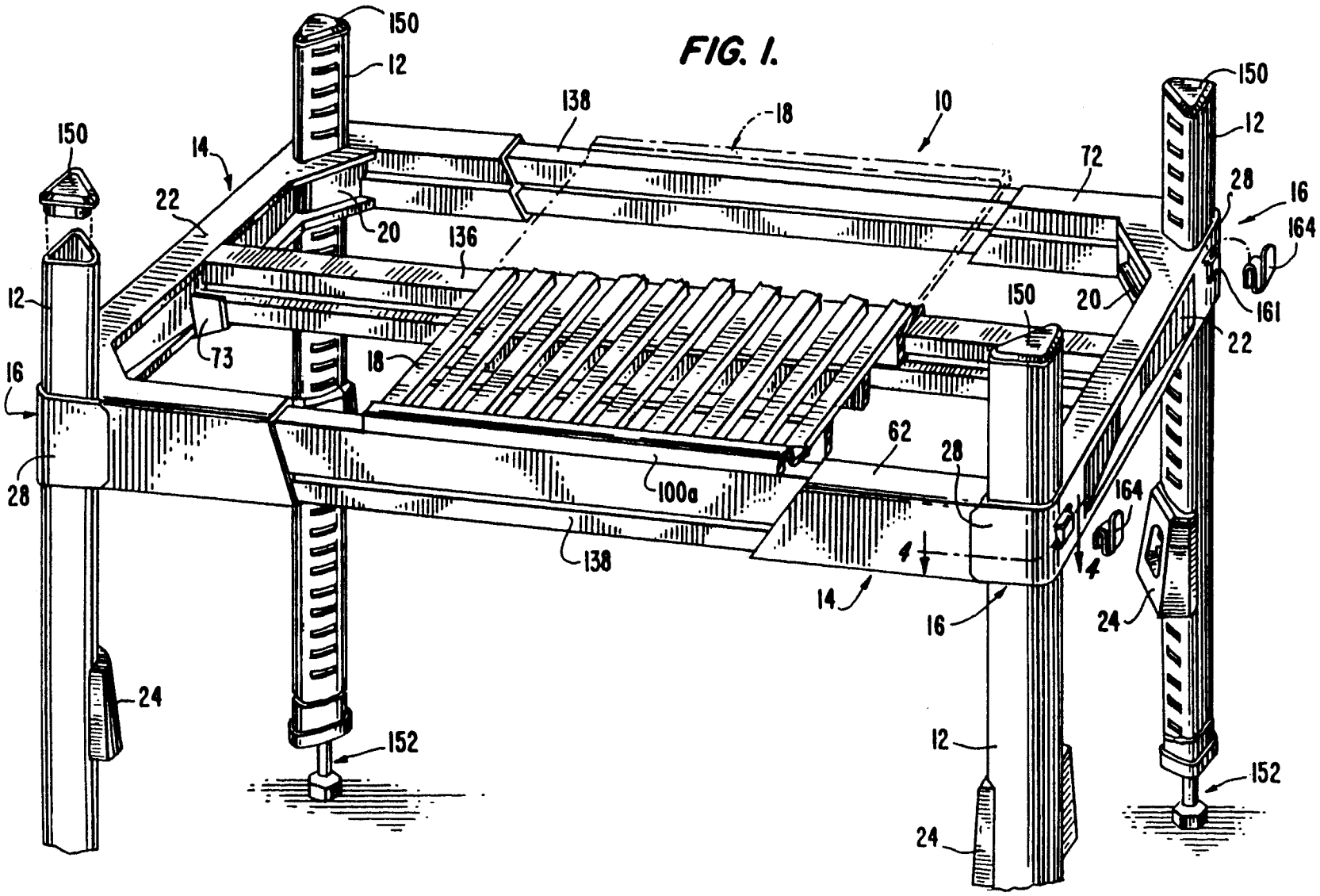
FIG. 1 is a perspective view of a shelving system in accordance with a preferred embodiment of the present invention.

FIG. 1 illustrates a shelving system 10 generally including four plastic support posts 12 arranged to support plastic support beams, generally indicated at 14, at the corners thereof via corner assemblies 16. The beams 14, in turn, support at least in part an assembly 18 of plastic support grids or mats.

The shelving system of the present invention includes several inventive aspects including (a) a modular frame or shelf design that permits various material, each desirable for the particular component, to be used and permits shelves of various dimensions to be assembled easily, (b) an improved shelf corner structure for mounting each shelf on a number of support posts, and (c) an improved high strength support post design.

For the purpose of explanation hereinafter, the locations of elements of the frame or shelving system of the present invention will be defined with reference to a shelf assembly to be supported. Accordingly, the term "interior" refers to the area defined by the interior of the shelf assembly, or facing therein, and the term "exterior" refers to the area outside of the shelf assembly, or facing therefrom. A particular element, however, such as a support post may be described with reference to its own interior or exterior.

A. MODULAR FRAME OR SHELF DESIGN

Generally, as shown in FIG. 1, the frame or shelving system 10 includes modular components so that shelf assemblies can be constructed of various desirable materials as described below, in a variety of different lengths, depending upon the application. To achieve this flexibility, the support beams 14 are of three types and include two generally C-shaped end beams 22 of one or more standard lengths connected by two side beams 138 and one center beam 136, both of which readily can be made of a variety of lengths. The side and center beams can accommodate different combinations of 12 inch center 100*a* and 18 inch end 100*b* shelf mats that rest on the end beams 22, and are snapped on the side beams 138, and center beam 136. In one embodiment, illustrated in FIG. 17, two 18 inch end mats 100*b* and one 12 inch center mat 100*a* are used. Of course, it is within the scope of the present invention to use mats of other lengths in many combinations.

Figure 24:
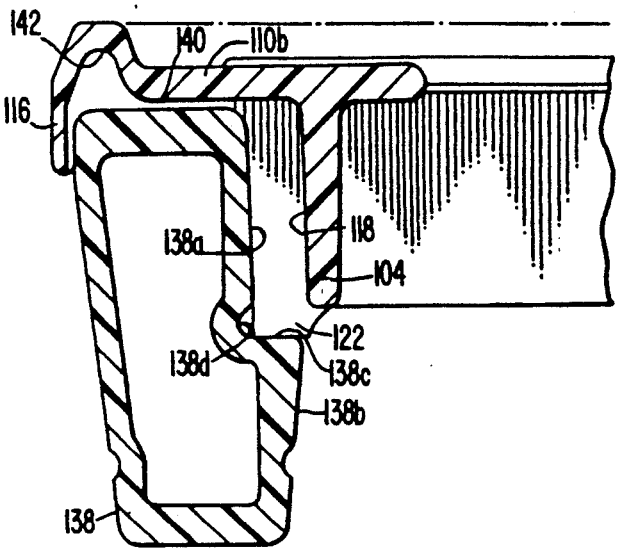
FIG. 24 is a fragmentary enlarged view of the circled portion "24" of FIG. 20 in combination with a side beam of the present invention.
Figure 26:
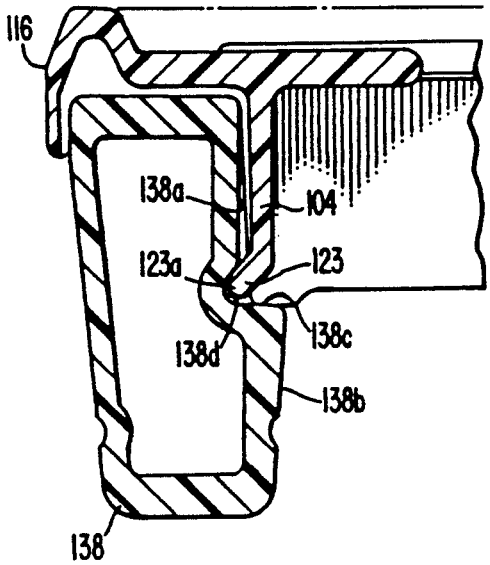
FIG. 26 is a fragmentary enlarged view of the circled portion "26" of FIG. 22 in combination with a side beam of the present invention.
Figure 33:
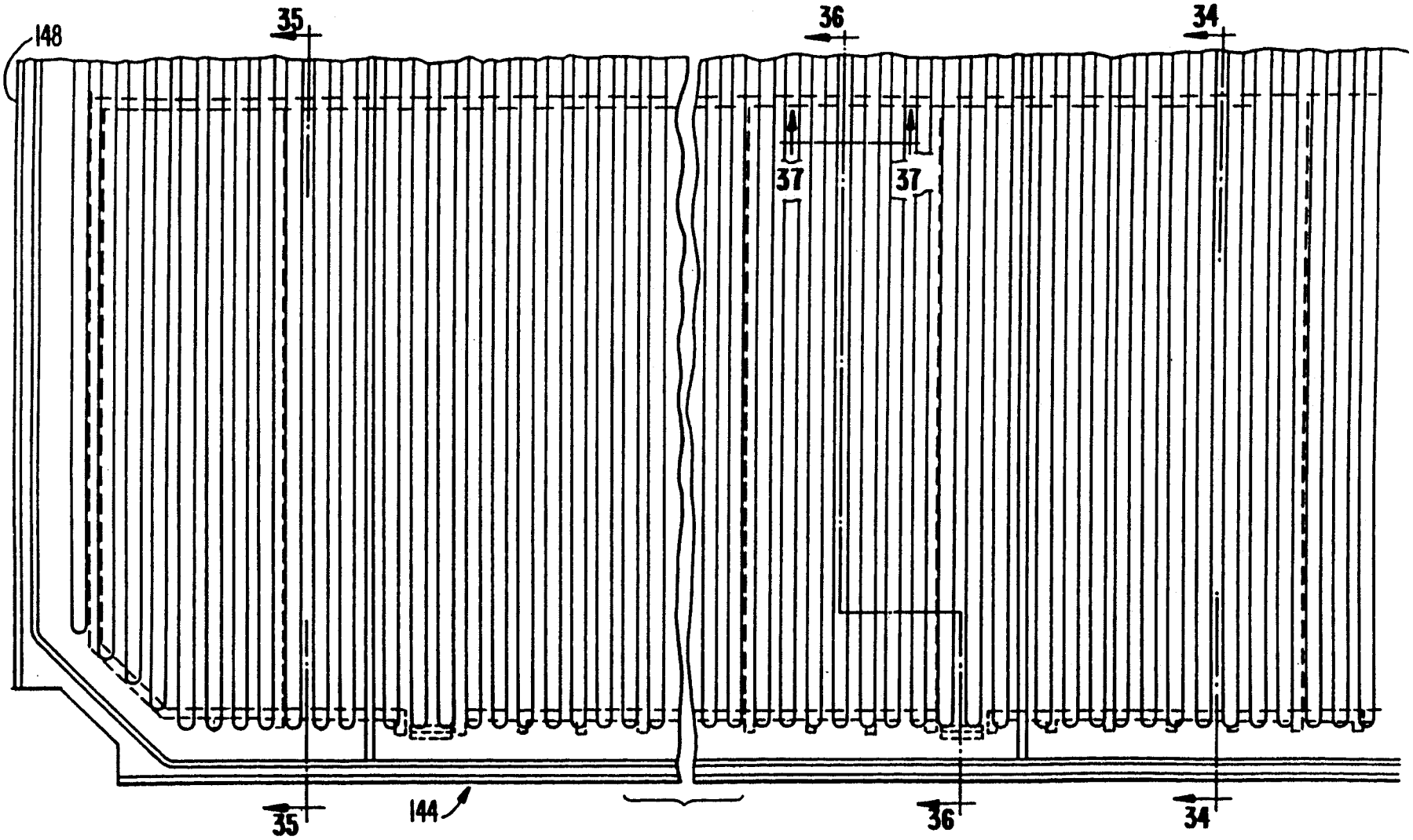
FIG. 33 is a top plan view of an alternative embodiment of a solid mat in accordance with the present invention.

The side arms 62 and 72 of an end beam 22 are joined by a central arm 60 at respective corner portion 20 and each has a cavity 62*a* and 72*a* therein which has a shape complementary to the cross-sectional shape of one side beam 138, best seen in FIGS. 24 and 26. This cross-sectional shape includes vertical inner upper and lower surfaces 138*a* and 138*b* joined by a horizontal surface 138*c* that has at one extreme a small fillet 138*d*, the functions of all of which will be described in greater detail below.

Figure 13:
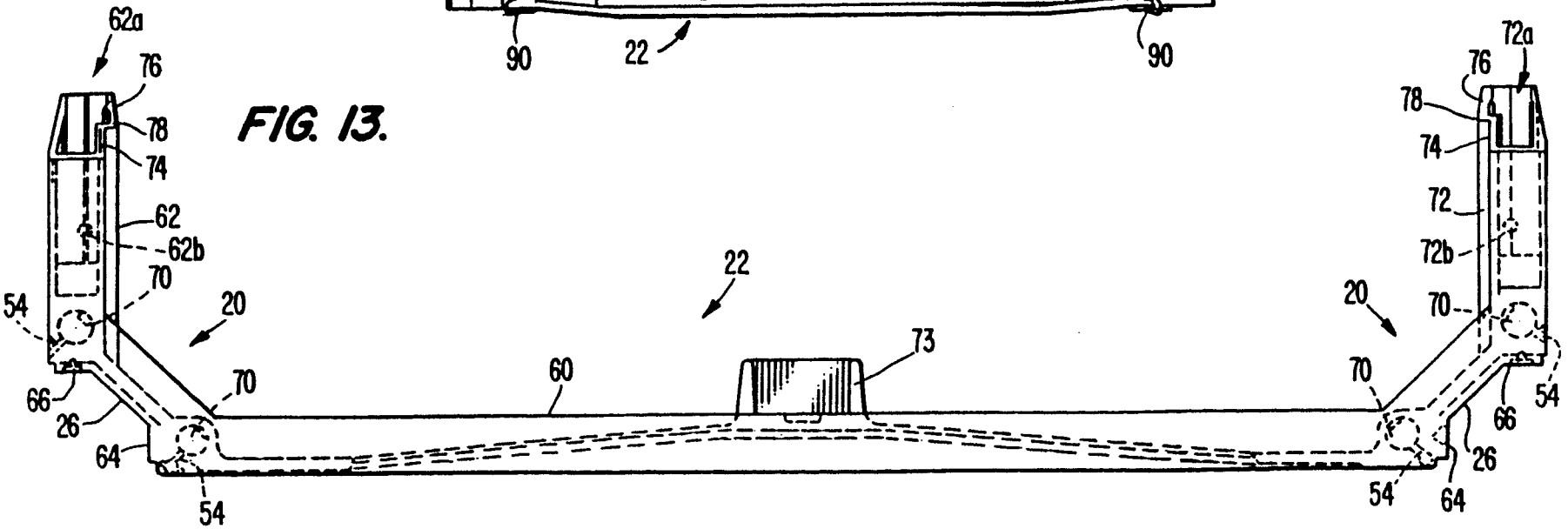
FIG. 13 is a plan view of the end beam of the present invention.

The center beam 136 has a generally rectangular box-like cross-sectional shape defined by opposing side walls, respectively having upper and lower vertically extending surfaces 136*a* and 136*b* joined by horizontal surfaces 136*c* all as shown in detail in FIGS. 30 and 31. A small fillet 136*d* is formed at the inner extreme of each horizontal surface 136*c*. A small hole 62*b* and 72*b* is provided in the bottom wall of the end beam 22 below the cavities 62*a* and 72*a*, as seen in FIG. 13. To secure a side beam 138 to an end beam 22, the side beam 138 is inserted in a complementary cavity 62*a* or 72*a*. Hot melted liquid adhesive is injected under pressure into the cavity through the hole. As a result, the adhesive surrounds the side beam 138 in the cavity and firmly secures side beam 138 within the cavity.

Figure 12:
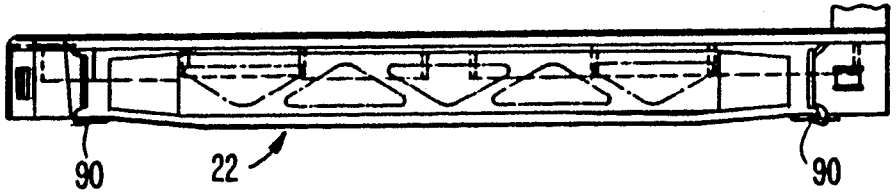
FIG. 12 is a side elevational view of a shelf of the present invention.
Figure 14:
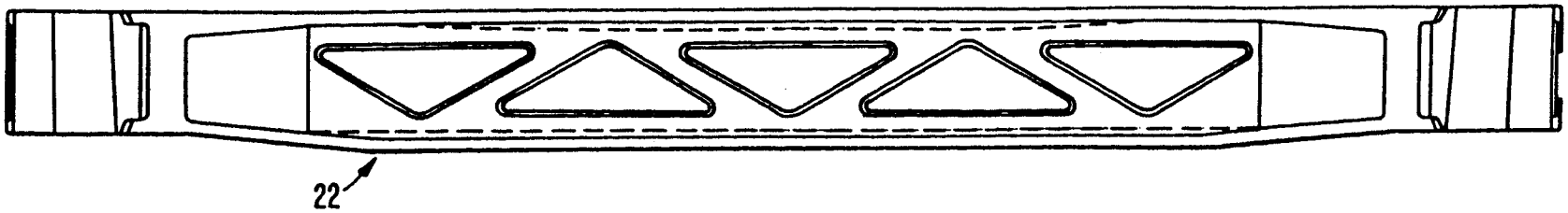
FIG. 14 is a side elevational view of the exterior of the end beam of the present invention.
Figure 15:
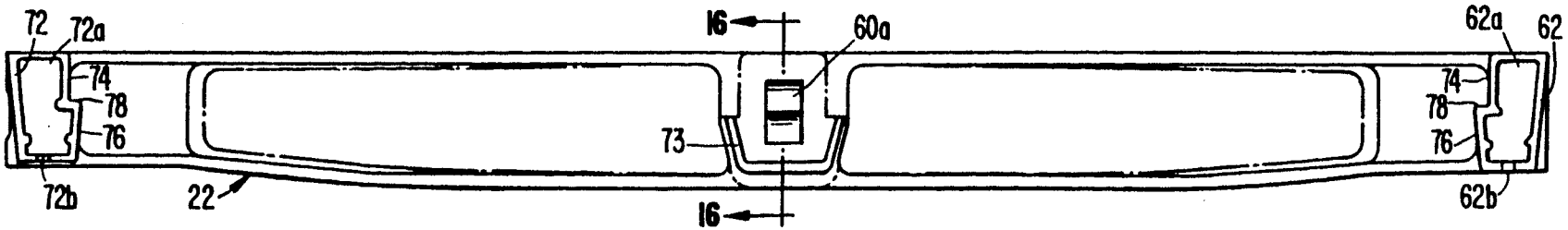
FIG. 15 is a side elevational view of the interior of the end beam of the present invention.
Figure 25:
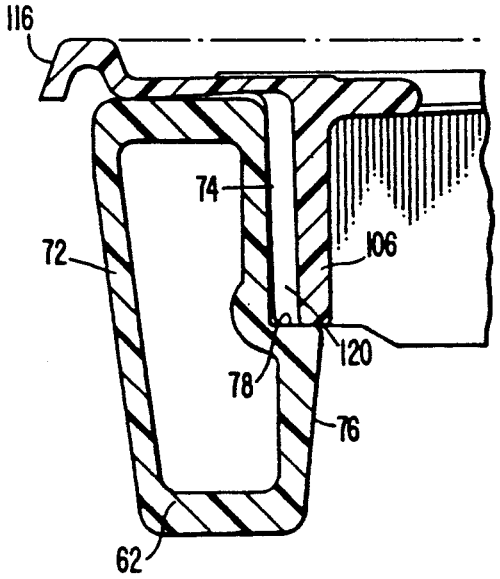
FIG. 25 is a fragmentary enlarged view of the circled portion "25" of FIG. 21 in combination with a portion of the end beam of the present invention.

The exterior surface of the arm 60 is concave in shape and the interior surface of the arm 60 is convex in shape as shown by phantom lines in FIG. 13. The exterior surface may have decorative triangular recesses therein as illustrated in FIGS. 12 and 14, on which various indicia can be embossed. As illustrated in FIGS. 1, 15, and 25, each of arms 62 and 72 has a step-shaped inner exterior face having a substantially vertically extending upper portion 74, a substantially vertically extending lower portion 76, and a substantially horizontally extending ledge 78 connecting the upper and lower portions. The arms 62 and 72 are shaped in this manner so that the lower surface of each of them is adapted to support an end mat 100*b* as will be described in more detail below.

Figure 16:
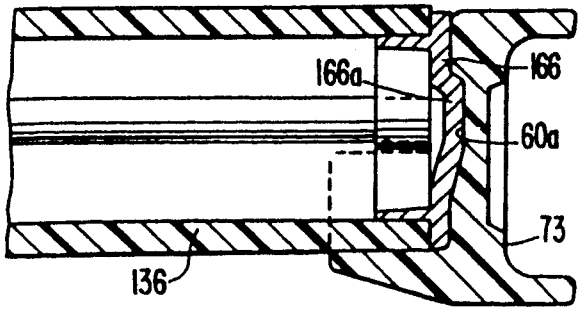
FIG. 16 is a cross-sectional view taken along plane 16—16 in FIG. 15 in combination with a center beam.

Once the end and side beams are secured to each other, each end of a center beam 136 may be placed on a generally U-shaped center beam support 73 located in the center of the interior side of each end beam 22, as illustrated in FIGS. 15 and 16. A center beam end cap 66, illustrated in FIG. 16, is attached to each end of center beam 136 and has a central knob 166*a* that snap-fits into a complementary notch 60*a* in the end beam 22. Next, a plurality of, for example, 12 inch and 18 inch mats 100*a* and 100*b* are laid onto end beams 22, and snap-fit onto the center beam 136, and side beams 138.

A sleeve is formed at each corner of the assembled shelf by a corner assembly 16 comprising, in part, the exterior surface 26 of each of the corner portions 20 of the end beam 22, and a collar 28, as will be discussed in Sections B and C in more detail below.

The described state of the assembly of the shelving system is shown in FIG. 1, although only one mat 100*a* has been shown for the sake of clarity. This entire structure may then lowered down on four posts 12, each having a wedge 24 snapped onto the interior face thereof, to seat each sleeve on support post 12 by wedging action with the wedges 24, thus to be supported thereby also as described in greater detail in Sections B and C below.

Furthermore, different types of mats can be friction fit or snap fit onto the assembly of two end beams 22, two side beams 138, and a central beam 136 described above. One type is an open matrix mat assembly 18, illustrated in detail in FIGS. 17 and 19 through 32. This type is composed of the end 100*b* and center 100*a* mat having longitudinally and laterally extending ribs forming a criss-cross pattern, with open spaces between the ribs. Alternatively, a second type, namely one having solid mats 144, can be provided, which is illustrated in FIGS. 33 through 37. Elements in solid mats 144 which are similar or identical to the elements in the open matrix mat assembly are identified by the same reference numerals. Further, the structure of the ribs and the elements providing the friction-fit with the support beams in the solid mats 144 have the same structure as those of mats comprising open matrix mat assembly 18 and therefore will not be described independently.

Figure 20:
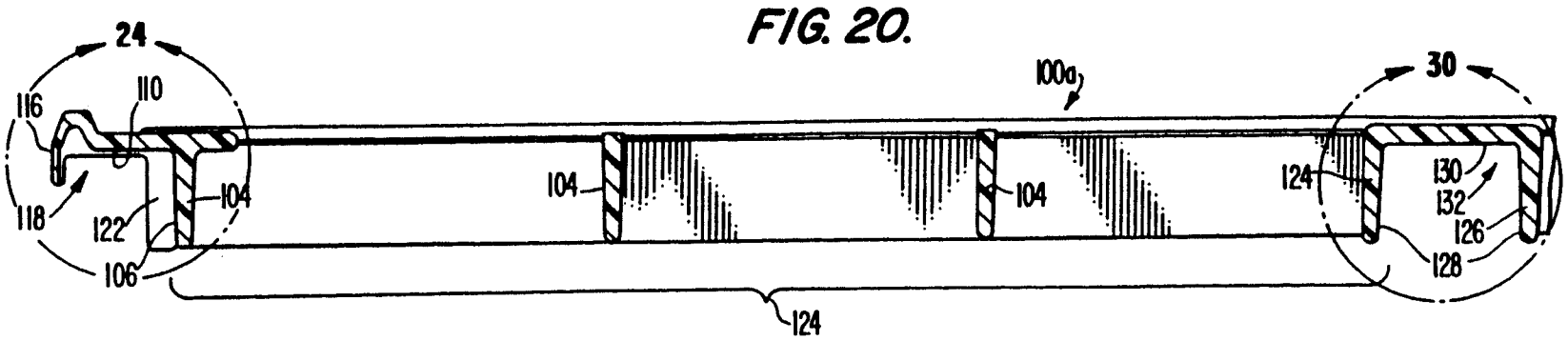
FIG. 20 is a transverse cross-sectional view of the open matrix shelf taken along plane 20—20 in FIG. 19.
Figure 21:
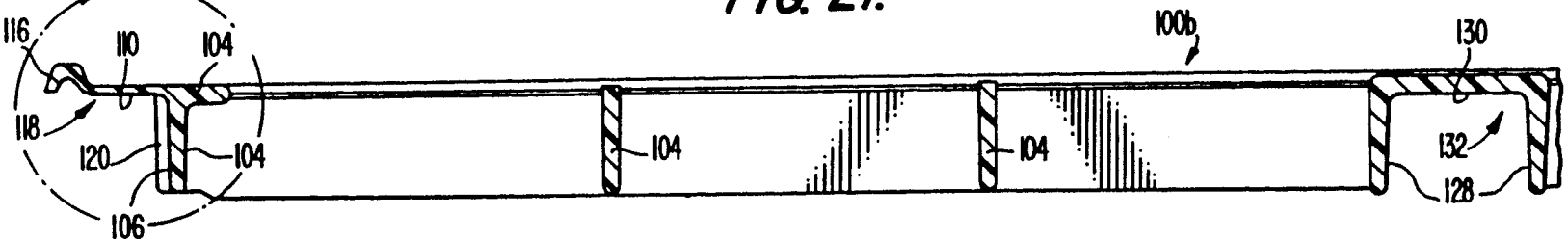
FIG. 21 is a transverse cross-sectional view of a portion of the open matrix shelf taken along plane 21—21 in FIG. 19.
Figure 22:
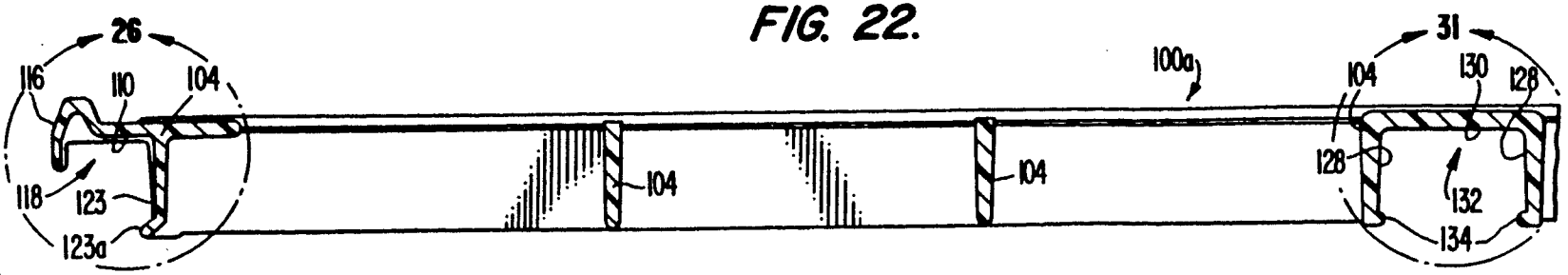
FIG. 22 is a transverse cross-sectional view of a portion of the open matrix shelf taken along plane 22—22 illustrated in FIG. 19.

Referring now to FIGS. 17 and 19 to 32, an open matrix shelf mat assembly 18 in one embodiment comprises one 12 inch center mat 100*a* and two 18 inch end mats 100*b*, as noted above. Each mat has an outer frame 108 and a plurality of downwardly projecting, criss-crossing ribs 104 attached to the outer frame, and spaced from the outer edge of the mat. The plurality of ribs 104 form an outer peripheral wall 106. Also provided, as seen in FIGS. 20 to 22, is an outer web 110 projecting outwardly from the upper edge of the peripheral wall 106. In addition, a flange 116 is provided which projects downwardly from the upper outer edge of the web 110. Flange 116, outer web 110 and outer peripheral wall 106 together define an outer channel 118 for engaging and resting on the top of an end beam 22 and for receiving the side beams 138 with an interlocking friction fit as will be discussed below.

On the sides facing the side beams 14 and the side arms 62 and 72 of the end beams 22, the outer peripheral wall 106 of each mat 100*b* also comprises a plurality of regularly spaced first spacers 120, one of which is illustrated in FIG. 21, projecting toward flange 116 for friction fitting against one of the arms 62 and 72 of the end beam 22. The outer peripheral wall 106 also is formed with a plurality of regularly spaced second spacers 122, one of which is illustrated in FIG. 20, projecting more closely to the flange 116 than the first spacers 120. The plurality of first spacers 120 are grouped serially in the direction of the length of the outer channel 118, and the plurality of second spacers 122 are spaced from the plurality of first spacers 120 and are also grouped serially in the direction of the length of the outer channel 118. A spring lug 123, shown in FIG. 22, separates the plurality of first spacers 120 and the plurality of second spacers 122. This spring lug 123 is formed by a portion of the outer peripheral wall 106 which extends closer to the flange 116 than the rest of the outer peripheral wall 106 and includes a depending bead 123*a* complementary to the fillet 138*d* in the side beams 138. The lug 123 is flexible and elastic so as to embrace and friction fit with the side beam 138 with the bead 123*a* received in the fillet 138*d*. One or more such spring 123 lugs are also positioned among the similar plurality of second spacers 122 in the 12 inch center mat 100*a*.

FIGS. 24, 25, and 26 show in detail how the side arms 62 and 72 of the end beam 22 and side beam 138 engage the channel 118 at different positions therealong, which are also represented in FIGS. 20, 21 and 22 respectively. FIGS. 27, 29, and 32 show cross-sectional views through different portions of ribs 104 in FIG. 19.

The outer channel 118 constitutes a beam embracing configuration along only two sides of the end mats 100*b* as described further below. Further, the plurality of first spacers 120 and the plurality of second spacers 122 extend along only two opposite sides of this mat, namely those sides of this mat adapted to embrace the side beams 138, and arms 62 and 72 of the end beam 22.

Referring again to FIG. 20, the plurality of ribs 104 comprise two spaced groups of ribs 124 and 126, each of which comprises an inner wall 128, extending downwardly from the upper surface of the mat. Each inner wall 128 is formed on the inside edge of a different group of ribs 124 or 126. The mat further comprises an inner web 130 connecting the two inner walls 128 to form a central channel 132 which is open at each lateral end and to the bottom. The channel 132 is adapted to receive the center beam 136 therein with a friction fit, as seen in FIGS. 30 and 31. The inner walls 128 may comprise a plurality of beads 134, illustrated in FIGS. 22 and 31, extending inwardly in mutually opposing relation. These beads 134 are shaped to be received in the fillets 136*d* of the center beam 136.

Figure 23:
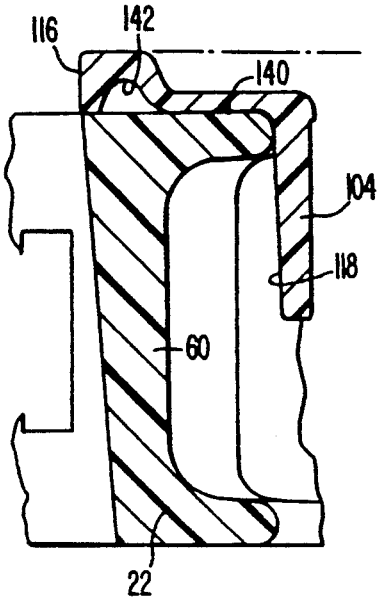
FIG. 23 is a cross-sectional view of a portion of the mat of FIG. 19 taken along plane 23—23 in FIG. 19.

As seen in FIGS. 23 and 24, web 110 of each end mat 100*b* comprises an upper portion 142 adjacent the flange 116, and a lower portion 140, extending below the upper portion 142 and adjacent the outer peripheral wall 106 and rib 104. The upper portion 142 is integral with the lower portion 140 and both extend along the entire length of the outer channel 118. As shown in FIG. 23 and 25, this configuration rests on the top of the central arm 60 and side arms 62 and 72 of the end beam 22, and as shown in FIG. 24 and 26 this configuration with its further depending flange 116 embraces the side beams 138, thereby to set the beams in the outer channel 118.

While in the embodiment discussed above the spacers and spring lugs for friction fitting the beams in the channels of the shelf mats are positioned on the mats, it is within the scope of the present invention to position the plurality of spacers and lugs on the beams.

Figure 34:
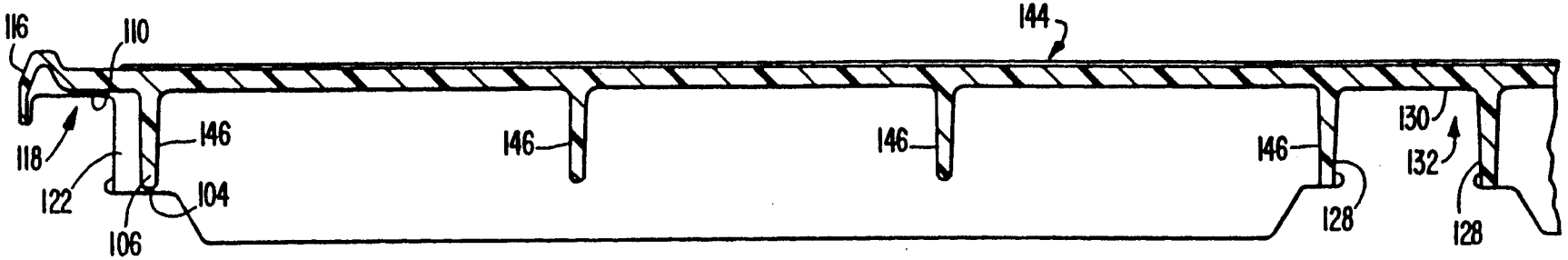
FIG. 34 is a transverse cross-sectional view of a portion of the mat of the present invention taken along plane 34—34 in FIG. 33.
Figure 35:
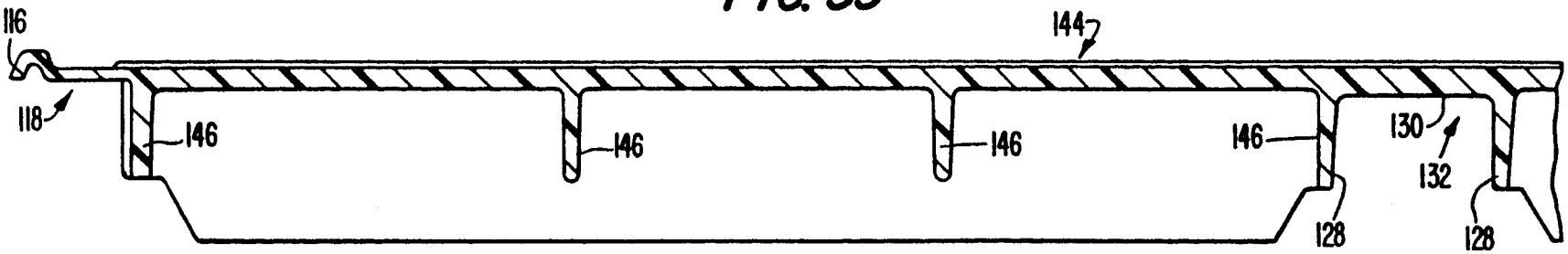
FIG. 35 is a transverse cross-sectional view of a portion of the mat of the present invention taken along plane 35—35 in FIG. 33.
Figure 36:
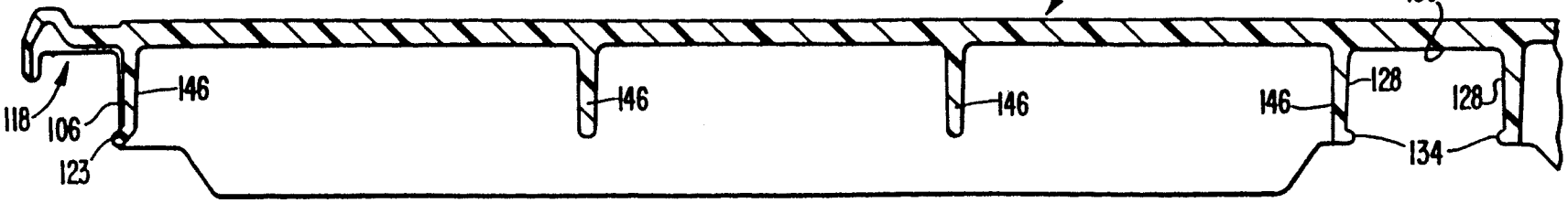
FIG. 36 is a transverse cross-sectional view of a portion of the mat of the present invention taken along plane 36—36 in FIG. 33.

As noted, in an alternative embodiment, the open matrix shelf mat 100 can be replaced by the solid shelf mat 144, illustrated in FIGS. 33 through 37, that comprises a frame 148, a plurality of ribs 146 attached thereto and extending downwardly, and solid material between ribs 146 as is illustrated in FIGS. 34 through 36. The friction fitting means of the solid shelf mats 144 have the same structure as the friction fitting means of open matrix shelf mats described above in detail.

B. IMPROVED SUPPORT POST DESIGN

Frames supporting shelf mats or other components assembled from components described above are supported on a plurality, usually four, of support or corner posts 12.

Figure 6:
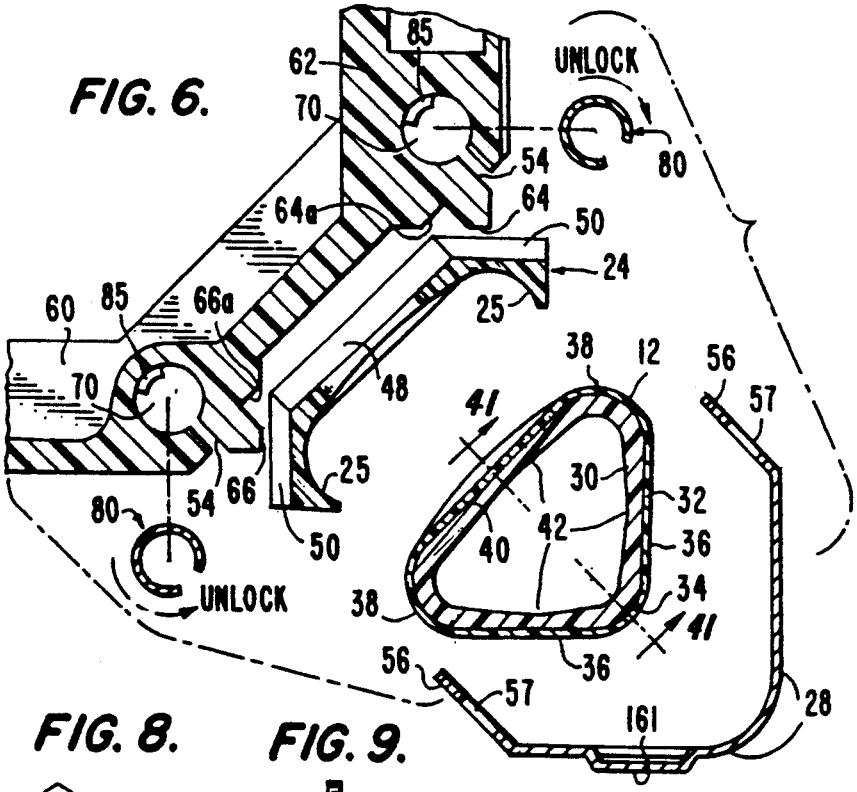
FIG. 6 is an exploded view of the corner assembly illustrated in FIG. 4.

Referring to FIG. 6, each support post 12 comprises a pultruded thermosetting plastic body 30, preferably thermosetting polyester, having unidirectional E Glass or other fibers extending therethrough, a random weave mat for providing torsional strength in the thermosetting plastic body, and a thermoplastic coating 32, preferably ABS or PET plastic, bonded to the outer surface of the thermosetting plastic 30. Coating 32 provides a durable impact resisting surface and prevents wicking of moisture into the fibers in the plastic body 30. In addition, side beams 138 and the center beam 136, described in detail in Section A above, can be made of pultruded thermosetting resin and are also coated with an ABS or PET plastic skin, in the same fashion as are the corner posts.

Figure 2:
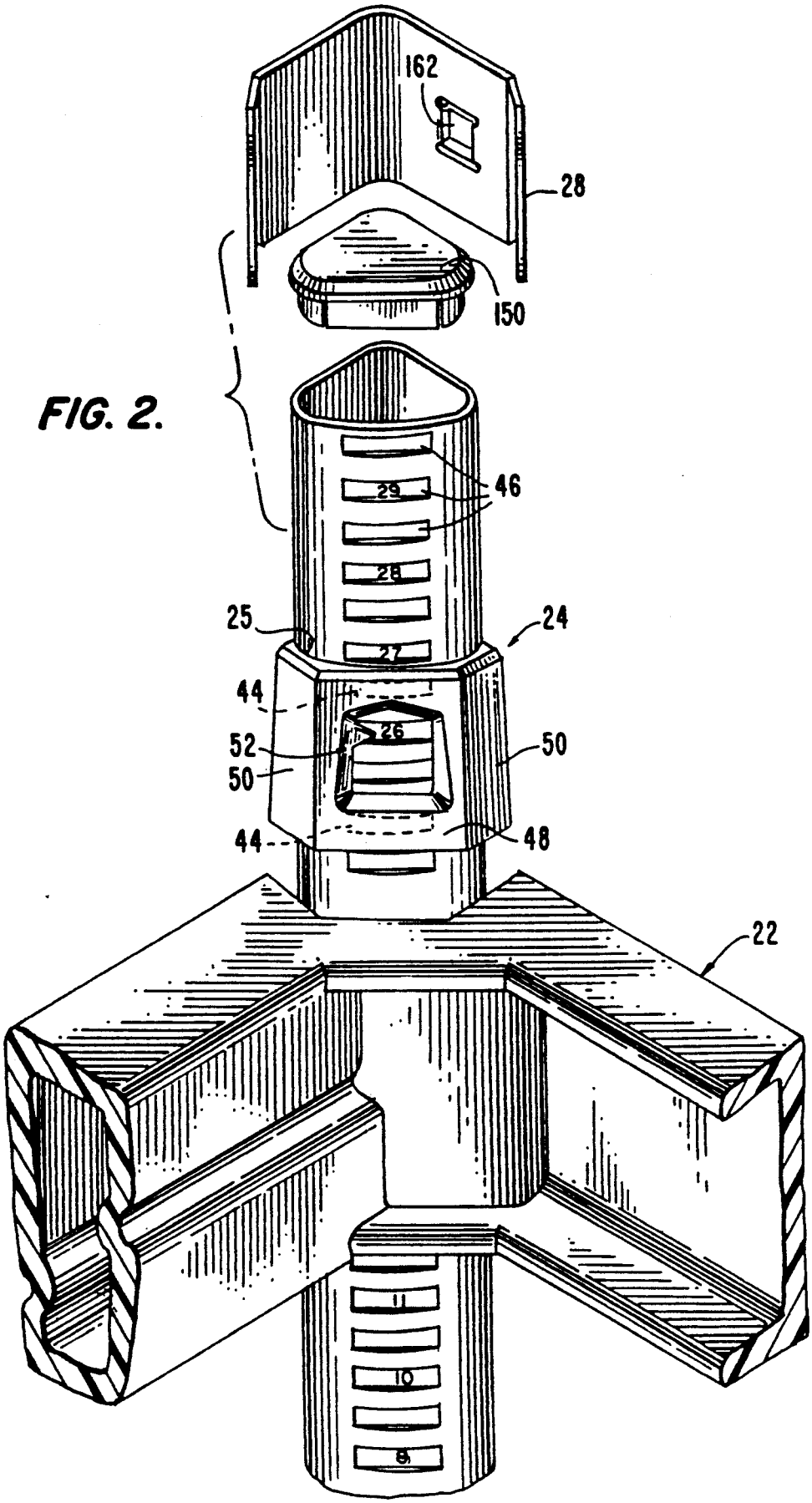
FIG. 2 is an perspective view of the corner assembly of the preferred embodiment shown in FIG. 1, as viewed from the interior of the shelf and exploded to illustrate features of a support post, a collar, a wedge member, and an end beam.

A number of detent steps 46 are formed or machined at periodic intervals along the vertical length of an interior side 40 of each support post 12, as seen in FIG. 2. However, the depth of these detent steps is less than the thickness of the thermoplastic coating 32. As a result, the structural integrity of the underlying thermosetting plastic body 30 is not compromised by the provision of detent steps 46, which otherwise might intersect the thermoplastic core or sever the fibrous reinforcement.

In the preferred embodiment, the maximum depth of the detent steps is approximately 0.05 inch, while the thickness of thermoplastic coating 32 on the interior side 40 is slightly greater than 0.05 inch. On the other sides 36 of support post 12 the thickness of the thermoplastic coating is between 0.015 inch and 0.030 inch.

As most clearly shown in FIG. 6, each support post 12 has a generally right equilateral triangular cross section in which the angular apexes are rounded. The right angular apex 34 and the two flat exterior sides 36 face the exterior of the corner assembly 16 and the two interior angle apexes 38 (formed symmetrically about plane 41—41 in FIG. 6) and the interior side 40 of support post 12 face the interior of the corner assembly 16.

In a preferred embodiment, each angular apex has a radius of 0.375 inch, and the distance from each interior angle apex 38 to its opposite side, along a line parallel to the exterior adjacent side, is 1.457 inch. Each of sides 36, 36, and 40 have a preferred thickness of approximately 0.065 inch at the center. The thickness increases to 0.075 inch at the end thereof adjacent the apexes. However, these dimensions may be changed to accommodate any specific application of the present invention.

Although each support post 12, and thus the corner assemblies 16 in frame or shelving system 10, are shown herein to be symmetrical, it will be appreciated that the geometry of the support post, and thus corner assembly 16 and shelving system 10, may be varied from symmetry without deviating from the inventive concept, provided that the respective geometries of the support post and the corner assembly are complementary. It has been found that the geometries of the preferred embodiment are advantageous.

Referring again now to FIG. 2, the detent steps 46 are formed every ½ inch, such that the height of the shelves in the shelving system may be set at predetermined intervals of ½ inch. The periodic interval, of course, may be varied to suit any particular application of the shelving system.

For further convenience, the detent steps 46 are sequentially numbered, facilitating easy location of each shelf corner at the same height on its respective support post 12 as discussed in greater detail below. In the preferred embodiment, the detent steps are sequentially numbered in whole inch intervals. Accordingly, only every other detent step is numbered.

Referring now to FIGS. 1, 2, and 6 it will be noted that the flat exterior sides 36 of the triangular cross-section of each support post 12 are parallel to the sides of the shelves 18. Accordingly, as explained in detail in U.S. Pat. No. 4,811,670 mentioned above, which is hereby incorporated by reference, the triangular geometry of the post provides structural rigidity to the shelving system in these directions.

In accordance with the improved design of the present invention, interior side 40 of each post 12 has an outwardly bowed inner surface 42 that causes the interior side 40 to project in the outward direction relative to the post against the wedge 24 in response to the weight of the shelves 18 being communicated to the posts 12 by wedging action. Thus, rather than collapsing inwardly under a large amount of weight, the inner surface 42 will tend to bow further outwardly of the post into tight engagement with the wedge 24.

In one embodiment, the inner surface 42 is convex in shape. Further, the maximum deviation of the inner surface 42 from a plane connecting its side edges is in the range of approximately 0.001 inch to 0.1 inch, and is preferably 0.01 inch.

Referring again to FIGS. 2, 4, and 6, the wedge 24 is designed to clip on to the support post 12 across the interior side 40. The face of the wedge member 24 adjacent the support post 12 is contoured to interfit therewith and includes a contoured lip 25 disposed on each of two opposing edges for embracing each interior angle apex 38 of support post 12, thus to clip the wedge 24 onto a support post 12.

Two detent tabs 44 are provided on the face of the wedge adjacent the interior side 40 of support post 12 and are spaced at intervals corresponding to the spacing of an integral number of detent steps 46 of the support post 12. The detent tabs 44 are designed to mate with detent steps 46 as seen particularly FIGS. 2, 4, and 6, in U.S. Pat. No. 4,811,670.

Although two detent tabs 44 are shown in the preferred embodiment, the wedge 24 may comprise one or more such detent tabs. Further, both the number and the size of the detent tabs may be varied for reasons of particular application, including, for example, the size of wedge 24, the size and spacing of detent steps 46, and the shelving application.

A detent tab 44 provides vertical support when it is seated in a detent step 46. It further locates each wedge 24 on a support post 12. It will therefore be appreciated that wedge 24 may be clipped onto support post 12 at any incremental height, and further may be translated up and down to any other incremental height thereon.

The face of the wedge 24 adjacent the corner portion 20 of the end beam 22 is inclined downwardly and outwardly at each of the three surfaces to form a central wedge portion 48 proximate the interior side 40 of the support post 12, and two side wedge portions 50, one located at each of the two opposing sides of the central wedge portion 48 and proximate the interior angle apexes 38 of the support post 12. The side wedge portions 50 are generally disposed in planes perpendicular to each other, each side wedge portion 50 also being generally perpendicular to the adjacent exterior side 36 of the post 12.

Referring again to FIG. 2, a window 52 is formed in the central wedge portion 48, for viewing the detent steps on the interior side 40 of the support post 12, thus for locating the wedge member 24 on the post 12. A triangular shelf height indicator is formed on window 52 for indicating the specific height at which the wedge member rests by pointing to a specific detent step 46. Window 52 is preferably large enough to expose two steps 46, so that a height indicating number associated with every other step can always be seen.

Reference to the sequentially numbered detent steps 46 permits each of four wedges 24 to be quickly and precisely located at the same height on each of the four support posts 12, such that a shelf may be supported thereon in a level orientation.

As shown in FIG. 2 and as noted above, each wedge member 24 is inclined, that is tapered, outwardly from its upper end to its lower end, such that the lower end extends toward the interior of the shelf support system. In the preferred embodiment, the taper is shallow to maximize rigidity and minimize the thickness of the wedge member and thus the amount of interior shelf space occupied thereby. For example, in FIG. 2 the taper of each face is of the order of 4 degrees.

The preferred material for the wedge members 24 is a bendable molded plastic. Such a bendable molded plastic wedge members can be easily clipped on to and off of the post. However, other materials which provide the desired characteristics may be used.

C. IMPROVED SHELF CORNER STRUCTURE AND SUPPORT SYSTEM

Each corner assembly 16 of each shelf incorporates an improved shelf support system in accordance with the present invention and includes, as illustrated in FIGS. 1 through 6, 13, and 17A, a support post 12, a corner portion 20 of each end beam 22, a wedge member 24 wedged between the exterior surface 26 of each corner portion 20, and a collar 28. The invention also provides improved means for locking the collar 28 on the corner portion 20 of the end beam 22. These means include a lock cylinder 80 for engaging the collar 28, and a button 90, both fit into a blind hole 70, which opens onto the lower surface of the end beam 22. The button rotates the lock cylinder 80 in the blind hole 70.

Figure 4:
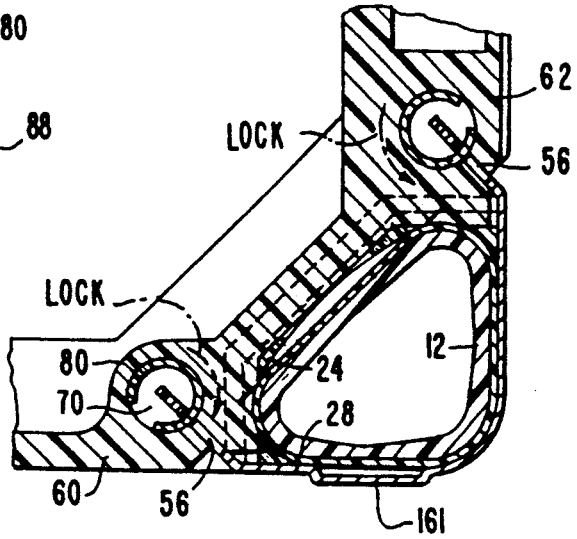
FIG. 4 is a horizontal cross-sectional view taken along plane 4—4 in FIG. 1 of the corner assembly of the present invention.
Figure 18:
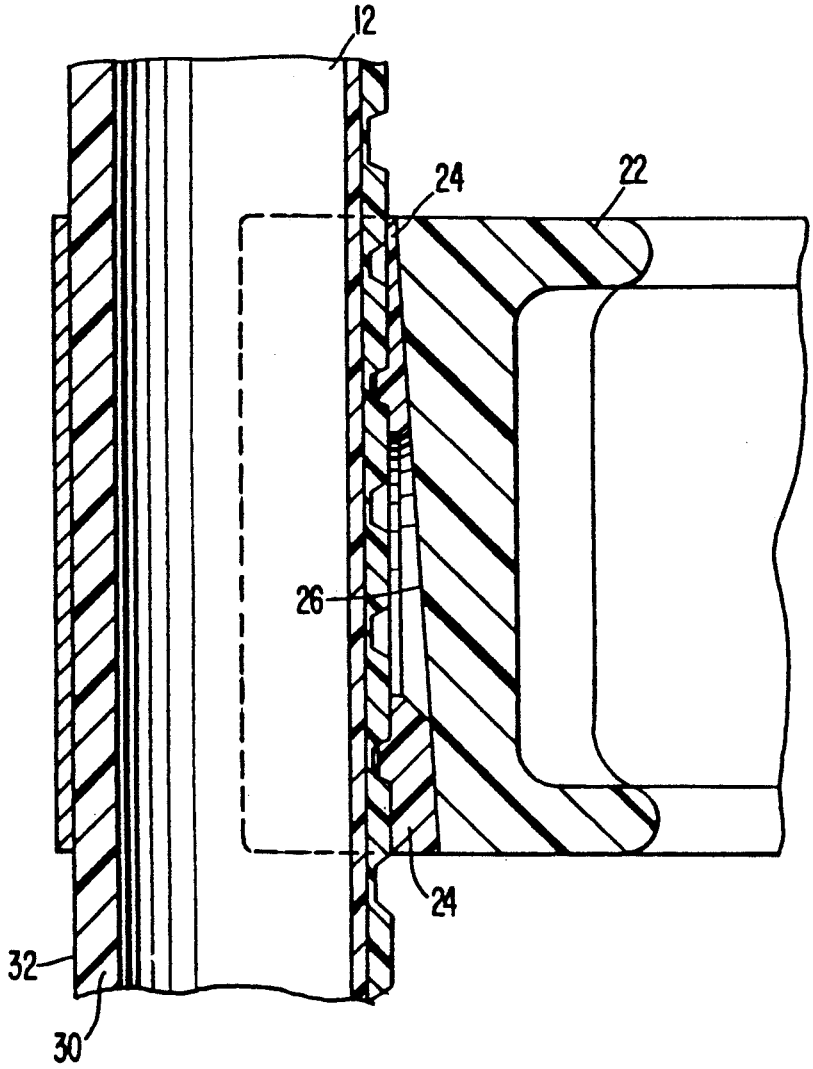
FIG. 18 is a cross-sectional view of a portion of the end beam, the wedge, and the support post taken along plane 18—18 in FIG. 17.
Figure 37:
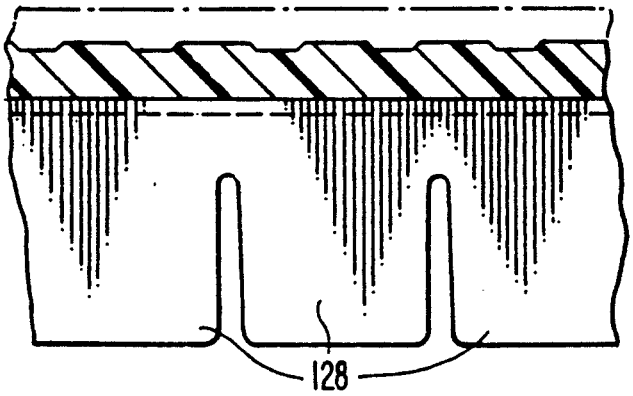
FIG. 37 is a cross-sectional view of a portion of the mat taken along plane 37—37 in FIG. 33.
Figure 19:
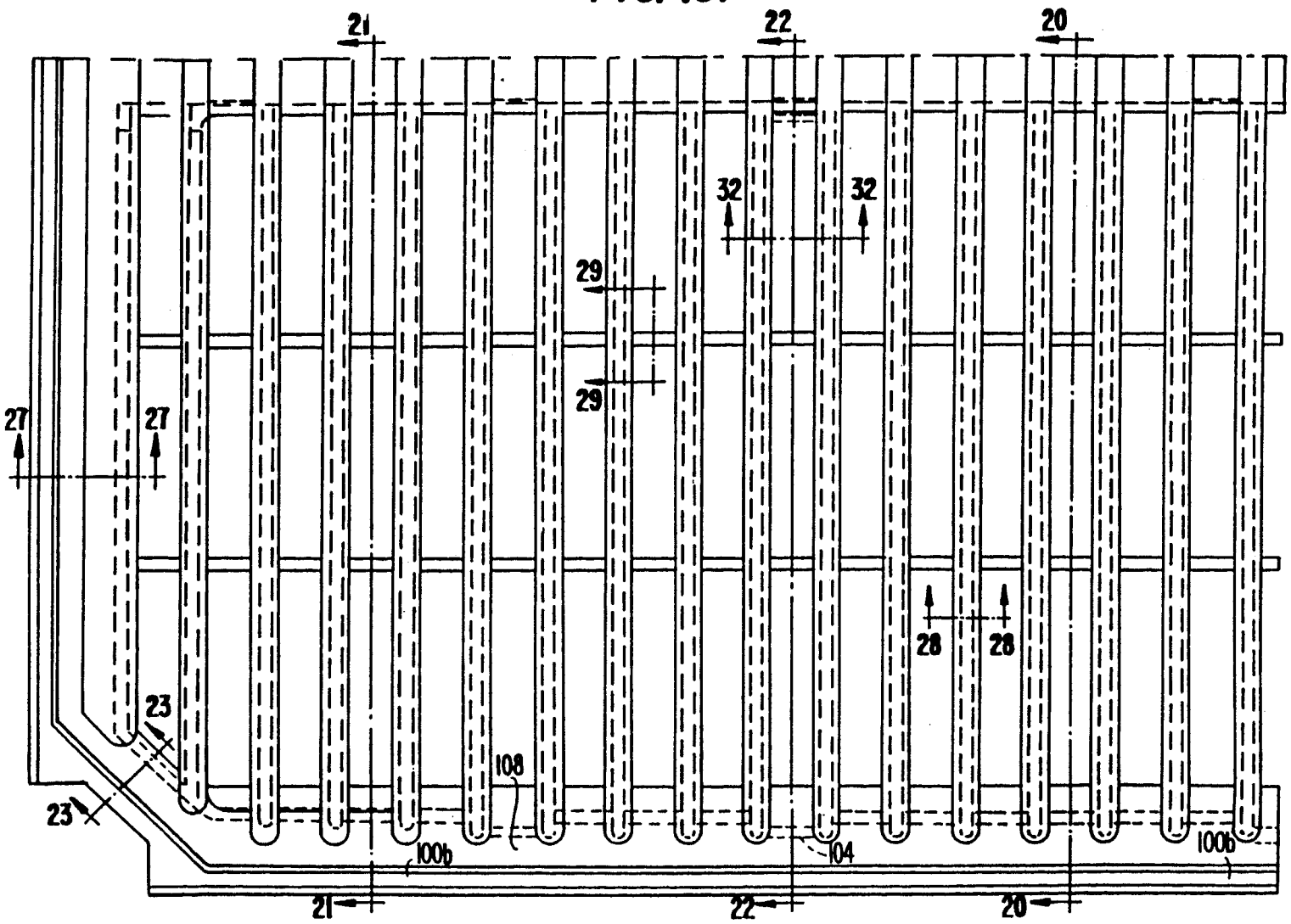
FIG. 19 is an enlarged fragmentary detailed view of the lower left hand portion of the mat illustrated in FIG. 17 and enclosed in a dashed loop.

More specifically, as shown in FIGS. 4, 6, and 13, each corner portion 20 of each end beam 22 in accordance with the preferred embodiment has a generally C-shaped configuration, in plan view, that mates with a wedge member 24. The corner portion 20 includes a tapered exterior face 26 inclined toward the interior of the shelving system from the top to the bottom, as illustrated in FIG. 18, and two tapered opposing end faces 64, 66. Each tapered face of the corner portion 20 corresponds to a respective portion of the wedge member 24. More particularly, each tapered end face 64, 66 corresponds to a side wedge portion 50 of the wedge member 24; exterior face 26 corresponds to the center wedge portion 48; and the degree of taper of each of these faces corresponds to its respective tapered portion of the wedge member 24.

The end beam 22 further comprises the central arm 60, and the side arms 62 and 72, as illustrated in FIGS. 4, 6, and 13 and as described above. Each corner portion 20 has two spaced slots 54 therein, each opening onto an exterior lateral surface of the end beam 22. The slots 54 are respectively formed near one end of a lateral wall of the arm 60 and the arm 62 of one corner portion 20. Each slot 54 is formed to receive a tongue 56 of the collar 28, whereby a sleeve for the post 12 is formed by the collar 28 and corner portion 20.

The arms 60 and 62 extend substantially perpendicularly to each other, as do the arms 60 and 72. As can be seen in FIG. 13, the arm 60 is connected to the arms 62 and 72 by different corner portions 20 of the end beam 22. As can be seen in FIG. 13 and 18, the arm 60 and arm 62 comprise end faces 64 and 66, respectively. End faces 64, 66, and exterior face 26 are substantially planar and are in different planes so that each end faces 64, 66 form an obtuse angle with the exterior face 26 of the corner portion 20.

Slots 54 each open onto an exterior lateral surface of arms 60 and 62 at a position spaced from the end faces 64 and 66, respectively. An acute angle is formed between each slot 54, and the arm containing the slot.

As noted above, each end beam also includes a third arm 72 and a second corner portion 20 identical to corner portion 20 between arms 60 and 62 described above. The end beam 22 also has two additional blind holes 70, one in arm 72 and one in arm 60, and two additional slots 54. The disposition and dimensions of the two additional blind holes 70 and the two additional slots 54 are identical to the dimensions and disposition of the blind holes 70 and slots 54 in the arm 60 and the arm 62 as described above. As mentioned before, each blind hole 70 opens onto the bottom surface of one of arm 60, arm 62, and arm 72 and is shaped to receive a lock cylinder 80 shown in FIGS. 3 through 7 therein, for locking tongue 56 of collar 28 to the end beam 22 when the tongue 56 is inserted into a slot 54 and into a blind hole 70 as will be discussed below.

Figure 3:
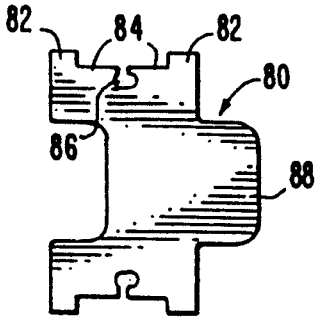
FIG. 3 is an elevational view of a lock cylinder blank before the blank is formed into a lock cylinder.
Figure 5:
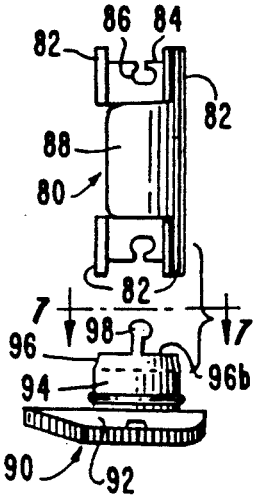
FIG. 5 is a side view of the lock and button of the present invention.

Each lock cylinder 80 can be received and rotated in a blind hole 70 between locked and unlocked positions since each has the shape of a cylinder, part of the surface of which has been cut away. The cylinder 80 may be formed from a flat piece of metal as in FIG. 3, is rolled into the cylindrical shape as seen in FIG. 5, and is symmetrical about a horizontal center line.

One end of .each lock cylinder 80 comprises two spaced lugs 82 extending in the axial direction of lock 80. The lock cylinder 80 also includes two intermediate ledges 84, each of which is adjacent and lower than each lug 82 and extends toward the other intermediate ledge. The lock further includes a keyhole 86 connecting the two ledges 84 and extending beneath the intermediate ledges. The keyhole 86 has two vertical straight ends and an enlarged portion between the two vertical straight ends. The lock cylinder 80 also includes a circumferentially extending central tongue 88, positioned between its two ends, which is shaped to be received in an opening 57 of one tongue 56 of a collar 28.

Figure 7:
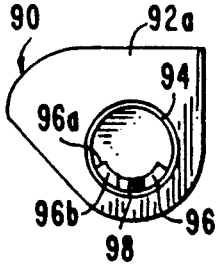
FIG. 7 is a bottom view of the button taken along plane 7—7 in FIG. 5.
Figure 11:
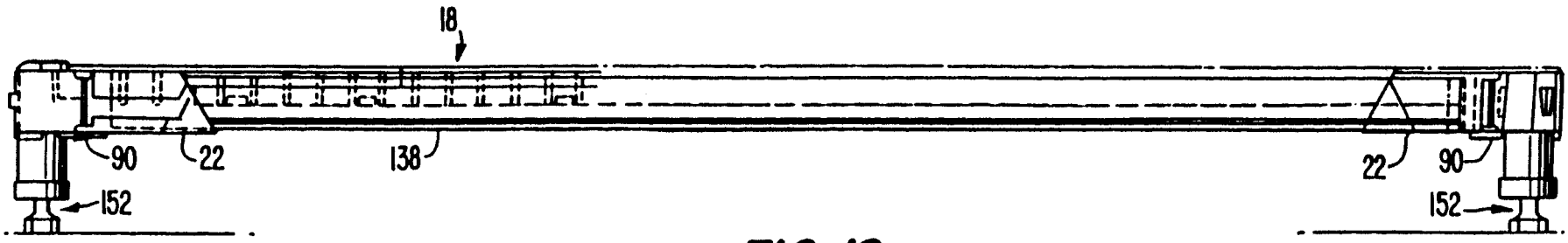
FIG. 11 is a side elevational view of a mat supported by a side beam, two end beams, and a support post.

The lugs, ledges, and keyhole of the lock cylinder 80 are formed, when rolled into a cylinder, to engage a button 90. Each key button 90, as seen in FIGS. 5, 7, and 11, comprises a eccentrically shaped head 92 which on respective buttons used at one corner portion are mirror images and the lateral extent of which is greater than the diameter of the blind hole 70. Each button head 92 has a flat sidewardly extending block 92*a*, best seen in FIG. 7. The button head 92*a* prevents each button from being rotated to an unlocked position when a post is received in a corner sleeve, as will be appreciated from FIG. 17A. The key button 90 also has a cylindrical stem 94 integral with the head 92 shaped to be received by being snap-fit into the blind hole 70, and an arcuate ear 96 extending from the stem 94.

The ends 96*a* of the ear 96 engage the two lugs 82 and the top surface 96*b* of the ear 96 engages the ledges 84 when the lock cylinder 80 is positioned in the blind hole 70 and when key button 90 is properly inserted into blind hole 70. The lugs 82 and ledges 84 at the opposite end of the lock cylinder 80 receive a stop 85 formed on the roof of each blind hole such that engagement of the lugs 82 with the stop limits rotational movement of the lock cylinder 80. The key button 90 also comprises a key projection 98 having a shape complementary to one keyhole 86 of lock 80 to be received therein.

As described above, each collar 28 has two tongues 56, each having an opening 57 therein, as shown in FIG. 6. Each tongue 56 has a size enabling it to fit through one slot 54 into a blind hole 70 as seen in FIG. 4. The opening 57 in each tongue 56 is thus positioned so that when the collar 28 is completely inserted into the slots 54, the opening 57 is positioned in a blind hole 70 to receive one tongue 88 of a lock cylinder 80 therethrough when the cylinder is rotated to the locked position, as illustrated in FIG. 4 and 6.

More specifically, when the head 92 of associated key button 90 is rotated, its ear 96 engages lugs 82 to cause rotation of the lock between locked and unlocked positions. For example, the lock cylinder 80 in the end of the arm 60 is rotated counterclockwise from its unlocked to its locked position, and the lock cylinder 80 in the arm 62 is rotated clockwise from its unlocked to its locked position, as illustrated in FIGS. 4 and 6. In the unlocked position, the tongue 88 of each lock cylinder 80 is disengaged from the opening 57 of an associated tongue 56 of a collar 28.

Figure 17A:
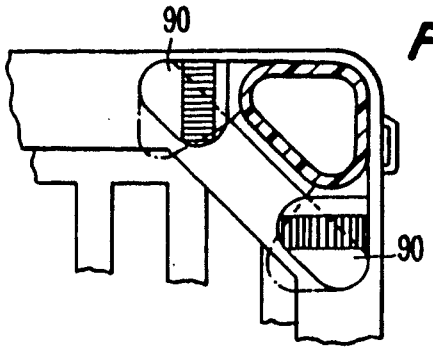
FIG. 17A is a bottom view of the corner assembly showing keys 90.
Figure 17:
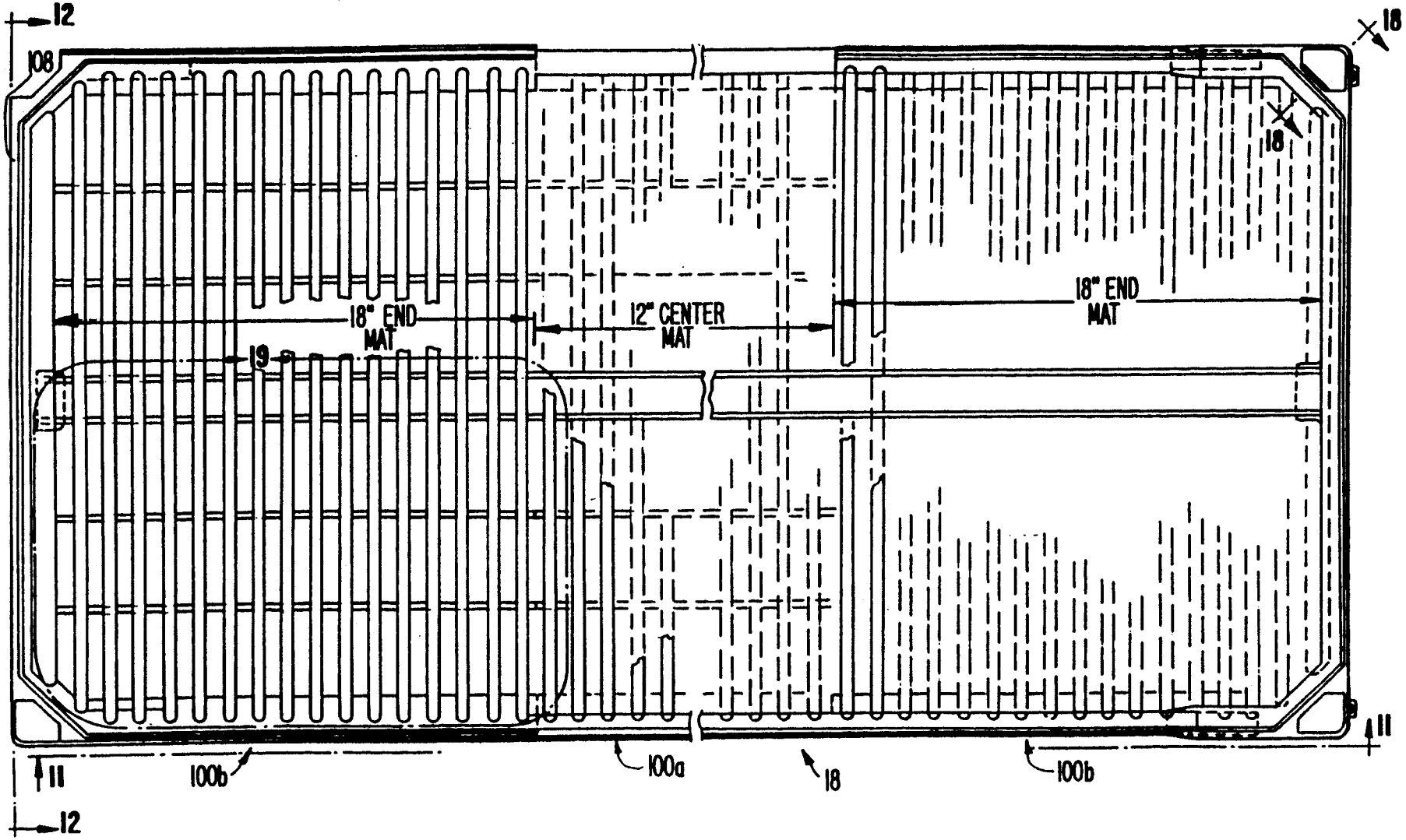
FIG. 17 is a top plan view of two eighteen inch end mats and one twelve inch center mat comprising an open matrix shelf of the present invention.

When the key button 90 is rotated to rotate a lock 80 cylinder into its locked position, the arcuate portion of the periphery of head 92 is spaced inwardly from the lateral edges of end beam 22 as can be seen at the upper portion of FIG. 17A. However, in one embodiment when a button 90 rotates a lock Cylinder 80 to its unlocked position, block 92*a* extends beyond the lateral edges of end beam 22 into the space that might otherwise be occupied by a wedge member 24 mounted on a support post 12 as can best be seen in the lower portion of FIG. 17A. As a result, the block 92*a* prevents entry of support post and wedge 12 into the interior of the sleeve formed by a collar 28 and a corner portion 20 of an end beam 22. Therefore, if the collar and corner portion of an end beam are not properly locked together the system of the frame and support post cannot be assembled. This feature of the invention can be omitted if desired.

Figure 10:
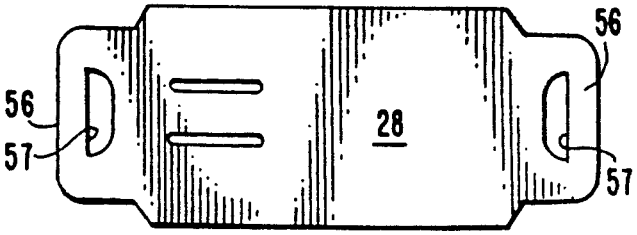
FIG. 10 is an elevational view of a collar blank before it is formed into the collar.

As shown in FIG. 10, each collar 28 may be formed from a flat piece of metal worked into the shape seen in FIG. 6. The collar 28 comprises a generally V-shaped body 28*a* having a rounded apex and two legs, and two tongues 56 extending from the ends of different legs of the body. The length and orientation of the two legs of collar 28 match those of exterior sides 36 of post 12 to form a tight sleeve therefor, as seen in FIG. 4.

Although the embodiments discussed above position the blind hole and slot on the end beam and place the tongue on the collar, it is within the scope of the present invention to reverse the arrangement so that the blind holes and slots are in the collar and the tongue which is inserted into the slot and blind hole is integral with the end beam.

Still further provisions can be made for use of the frame system of the present invention in applications that might experience high vibration. More particularly as shown in FIG. 6, the tapered corner portion faces 64 and 66 may each be formed with a void 64*a* and 66*a* respectively. The side wedge portions 50 may be formed with complementary projections (not shown). When the frame system is assembled, then the void and projections fit together to resist disassembly due to vibration or other random forces.

The shelving system also comprises an end cap 150 illustrated in FIGS. 1 and 2, which is shaped to fit within and the top of each support post 12.

Figure 8:
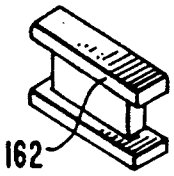
FIG. 8 is perspective view of a hole filler for filling the slot in the tab projecting from the outside of the collar.
Figure 9:
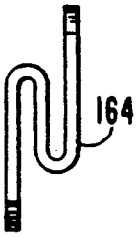
FIG. 9 is an end view of an S-hook of the present invention used to link two adjacent shelving systems through a slot in a tab of the collar of the respective systems.

Each collar 28 includes a tab 161 having slots therein, as illustrated in FIGS. 1, 4 and 6, for receiving an S-hook 164 illustrated in FIG. 9. An S-hook 164 is formed to engage the slot in each tab 161 in the shelving system 10 and is adapted to simultaneously engage a slot in an identical tab 161 of an identical collar 28 in an adjacent shelving system, thereby connecting the two shelving systems together. If the S-hook 164 is not used, a hole filler 162 maybe provided to fill the tab 161 slot, as illustrated in FIG. 8. The hole filler 162 engages the slot in the tab 161 as seen in FIG. 2.

D. SUMMARY

Accordingly, the present invention incorporates the advantages of metal shelf support systems having triangular post and corner geometry without the weight of such systems and without being susceptible to corrosion. Thus, it will be appreciated that the exterior sides of the triangular cross-section support post are flat and parallel to the edges of the shelf to be supported, and parallel to the primary directions of forces experienced by the shelf support system and the shelving system. The triangular geometry thus provides multi-directional stability, yet provides particular stability in the critical directions of the load forces.

Further, in the present system, the triangular post and collar geometry and the wedge member construction together assure that the wedge member will always be captured in the same orientation. This feature, for example, always positions height index numbers in the same way facing inconspicuously inwardly of the shelf.

Another advantage of the present invention is that the shelving system can be made to order in a variety of lengths by combining different numbers of 12 inch and 18 inch mats, or by combining mats of other lengths, with cooperating side beams of the appropriate length.

A further advantage of one embodiment is that the support posts assembled with wedges are blocked from being inserted into the sleeve formed by a collar and an end beam when the key button is used to rotate a lock cylinder to the unlocked position, thereby preventing the assembly of the shelving system in an unsafe condition or disassembly under load.

Still another advantage of the present invention is that the detent steps are formed in the thermoplastic coating rather than the thermosetting plastic body of each support post, thereby maintaining the structural integrity of the thermosetting plastic body and its fibrous reinforcement.

The inner surface of a post is curved or bowed outwardly of the post. As a result, when weight is borne by the post, the exterior surfaces are urged outwardly to prevent collapse of the post.

Another advantage of the present invention is that the shelving system can be easily assembled or disassembled by snapping or unsnapping a shelf onto the support beams, locking or unlocking the lock cylinders to attach or disconnect collars from the end beam, and moving the sleeve formed by each collar and associated end beam upwardly or downwardly on a support post. No tools are required.

The height of a shelf may be easily changed to accommodate a variety of shelving applications. To change the height of a shelf, the end beams are first moved upwardly to relieve the wedging forces at each corner and to expose the respective wedge members. Each wedge member is then clipped off and clipped back onto the support post at the desired new height. As each wedge member is provided with detent tabs and a window having a shelf height indicator, and each support post is provided with sequentially numbered detent steps, each wedge member can be quickly relocated on its respective post at the same, predetermined height. The shelf is then moved downwardly and supported at the new desired height by wedging action between the sleeve, wedge and post. A particular advantage of this feature is that no tools are required to effect the adjustment of the shelf.

A further advantageous feature of the present invention is the ability to insert and remove an interior shelf from the shelving system without removing adjacent shelves or at least partially disassembling the overall shelving system. To insert an interior shelf, a wedge member is first clipped on each support post at the desired height. The shelf assembly is then slightly tilted to allow insertion between the four support posts, at a position above the wedge members. Collars are then secured to each corner of the end beam of such interior shelf by means of the locks 80 thereby to form sleeves respectively embracing each post. The shelf is then moved downwardly such that each sleeve seats on an associated wedge member to support each corner of the shelf by wedge action. Similarly, an interior shelf may be removed without removing adjacent shelves or at least partially disassembling the overall shelving system simply by reversing the above procedure. Again, a particular advantage of this aspect of the present invention is that it requires no tools to effect the insertion or removal of the interior shelf.

It will also be appreciated that the triangular post and sleeve geometry maximizes the available shelf space without sacrificing stability. As is clearly evident from FIG. 1, the triangular support post of the present invention occupies only a small, corresponding triangular section of the shelf corner. Only the thin collar is disposed outside of the support post. In this manner, substantially the entire interior of the shelf may be utilized to bear load. Further, as only the thickness of the collar extends outside of the support post, it will be appreciated that a number of shelving units utilizing the shelf support system of the present invention may be attached to each other, by S hooks, forming substantially continuous shelves therebetween.

Additionally, each of the components of the shelf support system may be easily and inexpensively manufactured. Although specific examples are disclosed in detail above, other materials and manufacturing techniques may be used according to the application which the shelving system of the invention is to the post.

Although specific embodiments of the present invention have been described above in detail, it will be understood that this description is merely for purposes of explanation. Modification of the preferred embodiments described herein may be made by those skilled in the art without departing from the scope of the present invention which is set forth in the following claims.

We claim:

1. An end beam for supporting a shelf-like structure, comprising:

a body, having a major dimension, adapted to support the structure, said body including a corner portion formed with two spaced holes extending generally transversely to said major dimension and two spaced slots therein, each slot opening to an exterior surface of said body, each slot further opening into an interior of a different hole;

a collar having a pair of tongues each formed to be received in one slot and to extend into an associated hole; and means for locking said tongues in each said hole and to project into an associated hole whereby a sleeve for receiving a support post is formed by said collar and said corner portion.

2. The end beam defined by claim 1, wherein said body comprises fiberglass-reinforced thermoplastic resin.

3. The end beam defined by claim 1, wherein said body comprises a first arm extending on the direction of the major dimension formed with one of said holes and one of said slots, a second arm formed with another of said holes and another of said slots, said second arm extending in a different direction from said first arm, and a first corner connecting said first and second arms.

4. The end beam defined by claim 3, wherein said first and second arms each comprise an end face abutting an exterior face of said first corner thereby to form a three sided exterior corner surface of said beam adapted to receive a wedge therein.

5. The end beam defined by claim 4, wherein said end faces of said exterior face are substantially planar and are in different planes, and wherein each end face is inclined downwardly and inwardly of said beam.

6. The end beam defined by claim 4, wherein said slots respectively open onto an exterior surface of said first and second arms at a position spaced from said end faces.

7. The end beam defined by claim 3, wherein each said slot extends at an acute angle with respect to the direction in which said arm containing said slot extends.

8. The end beam defined by claim 3, further comprising a third arm and a second corner, wherein said second and third arms are integrally connected to opposite ends of said first arm by said first and second corners and extend in a direction substantially perpendicular to the direction of said major dimension in which said first arm extends;

said end beam further having two additional holes extending generally transversely to said major dimension, one formed in said third arm and one formed in said first arm, and two additional slots, one opening onto an exterior surface of said first arm and one opening onto an exterior surface of said third arm;

each said additional slot opening into an interior of a different additional hole;

wherein each said additional slot extends at an acute angle with respect to the direction in which said arm containing each said additional slot extends; and said end beam further comprising a second collar having a pair of tongues each formed to be received in one said additional slot and extend into an associate hole, whereby a second sleeve for receiving a support post is formed by said second collar and said end beam.

9. The end beam defined by claim 1, wherein said body comprises a first arm extending in the direction of said major dimension, said first arm having an interior surface and an exterior surface, and further comprising a generally center beam support projecting inwardly from said interior surface of said first arm for supporting a center beam.

10. The end beam defined by claim 1, wherein said corner portions has a generally C-shaped exterior corner surface and a bottom surface onto which each said hole opens.

11. The end beam defined by claim 10, wherein said corner portion has two lateral exterior surfaces adjacent opposite ends of said generally C-shaped exterior corner surface, and wherein each slot opens onto a different lateral exterior surface.

12. The end beam defined by claim 11, further comprising a first arm extending in the direction of the major dimension formed with one of said holes and one of said slots, and a second arm extending in a direction different from that of said major dimension formed with another of said holes and another of said slots, said first and second arms defining said C-shaped exterior corner surface, and wherein an acute angle is formed between each said slot and said arm containing said slot.

13. The end beam defined by claim 12, wherein each said slot is spaced from said generally C-shaped exterior corner surface.

14. The end beam defined by claim 1, further comprising two substantially identical corner portions, and two longitudinal arms each extending in a longitudinal direction from one of said corner portions, and a lateral arm joining said two longitudinal arms and extending in a lateral direction between said two corner portions, said longitudinal and lateral arms generally defining a plane, wherein each longitudinal arm has a step-shaped face including an upper portion extending transversely to the plane, a lower portion extending transversely to the plane, and a ledge connecting said upper and lower portions extending generally in parallel to the plane.

15. A subassembly of a modular frame system, comprising:

a first end beam, extending in the direction of a major dimension, formed with a first hole therein extending transversely to the direction of the major dimension, and a first slot extending in a direction transverse to the axis of said first hole and opening at one end into said first hole and opening at the opposite end onto an exterior surface of said first end beam; and a first lock shaped to be received in said first hole for movement between locked and unlocked positions for locking in said first hole a portion of an element passing through the first slot and received in the interior of said first hole.

16. The subassembly defined by claim 15, wherein said first hole is cylindrical and wherein said first lock is cylindrically shaped to be received for rotation in said hole between locked and unlocked positions.

17. The subassembly defined by claim 16, wherein one end of said first lock has two spaced lugs extending in the axial direction thereof.

18. The subassembly defined by claim 17, further comprising a first key for said first lock including:

a head the maximum cross-sectional dimension which is larger than the diameter of said first hole;

a stem integral with said head and having a size enabling said stem to enter said first hole; and an ear extending from said stem for engagement with said two lugs of said first lock when said stem is inserted into said first hole.

19. The subassembly defined by claim 17, wherein said first lock further comprises:

two lug portions on an upper surface of said lugs;

two intermediate ledges, one adjacent and beneath each lug portion, and each extending toward the other intermediate ledge; and a keyhole connecting said two intermediate ledges.

20. The subassembly defined by claim 19, further comprising a first key including:

means for engaging said two lugs and said intermediate ledges when said first lock is positioned in the first hole and when said key is inserted into the first hole; and a key portion having a shape complementary to said keyhole.

21. The subassembly defined by claim 19, wherein said first lock further comprises a tongue positioned between the two ends thereof.

22. The subassembly defined by claim 21, wherein said first lock is symmetrical about a plane passing through the center thereof.

23. The subassembly defined by claim 15, wherein said first lock comprises a lock tongue, wherein said subassembly further comprises a first collar having a first collar tongue with an opening therein, wherein said first collar tongue is shaped to be received in said first slot into said first hole, and wherein the opening in said first collar tongue is located so that when positioned in said first slot said lock tongue is received therethrough when said first lock is in its locked position.

24. The subassembly defined by claim 23, wherein said first lock is formed for rotation in said first hole between its locked and unlocked positions and wherein said subassembly further comprises a first key button for rotating said first lock, and wherein said first key button comprises:

a head shaped to prevent its insertion into said first hole; and a stem, smaller than said first hole, for engaging a portion of said first lock to rotate it between its locked position and its unlocked position, wherein when said collar tongue is inserted into said first slot said lock tongue, when in the unlocked position, is disengaged from said first collar tongue.

25. The subassembly defined in claim 24, wherein said first end beam has a second hole, extending transversely to the direction of the major dimension, and a second slot, extending in a direction transverse to the axis of said second hole and spaced from said first hole and said first slot, wherein said second slot opens at one end into said second hole and at an opposite end onto an exterior surface of said first end beam, and wherein said subassembly further comprises:

a second lock shaped to be received and rotated in said second hole and having a second lock tongue, wherein said first collar comprises a second collar tongue having an opening therein formed to be received in said second slot, the opening in said second collar tongue being positioned to receive the second lock tongue when said second lock is rotated to its locked position;

a first support post; and a first wedge mountable on said first support post, said first collar and the portion of said first end beam between said two holes forming a sleeve for receiving said first support post and said first wedge thereby to seat said first wedge on said support post by wedge action of said first wedge.

26. The subassembly defined by claim 25, wherein said first support post has a generally right triangular cross-section, and wherein said first wedge is mountable on an interior face of said first support post and has a wedge portion extending therefrom.

27. The subassembly defined by claim 26, wherein said first end beam has a generally C-shaped configuration and comprises:

a central arm;

two side arms; and two corners each joining one said side arm to said central arm, one of said corners being positioned between the first and second holes, said first end beam further having third and fourth holes and third and fourth slots having substantially the same structure as said first and second holes and slots, respectively, said other of the corners being positioned between said third and fourth holes;

said subassembly further comprising:

third and fourth locks; and a second collar, said third and fourth locks and said second collar have substantially the same structure as said first and second locks and said first collar, respectively, wherein said second collar is formed to be mounted with said first end beam by passing first and second tongues of said second collar through said third and fourth slots and into said third and fourth holes, respectively, and passing said tongues of said third and fourth locks through the openings in said first and second collar tongues, respectively;

a second support post; and a second wedge, mountable on said second support post, wherein a sleeve is formed by said second collar and a portion of said first end beam between said third and fourth blind holes which may be seated on said second support post and said second wedge by wedging action of said second wedge.

28. The subassembly defined by claim 27, further comprising:

a mat defining an article supporting surface of a shelf of said modular frame system; and means for mounting said mat on said first end beam.

29. The subassembly defined by claim 28, wherein said mat, said first end beam, said first and second support posts and wedges each comprise plastic wherein said mounting means comprises a first channel along the periphery of said mat and having a shape, complementary to said two side arms of said first end beam and comprising two lateral portions for engaging said two side arms of said first end beam.

30. The subassembly defined by claim 29, wherein said central arm defines an interior surface and an exterior surface, wherein said first end beam further comprises a center beam support projecting from said interior surface of said central arm, and wherein said subassembly further comprises:

a center beam support by said center beam support;

a second end beam having substantially the same structure as said first end beam;

fifth, sixth, seventh, and eight locks having substantially the same structure as said first lock and being formed to be received in fifth, sixth, seventh, and eighth holes, respectively, formed in said second end beam;

third and fourth collars;

third and fourth support posts;

third and fourth wedges, said third and fourth collars, said third and fourth support posts, and said third and fourth wedges have substantially the same structure as said first collar, said first support post, and said first wedge, respectively, wherein said shelf comprises a second channel comprising means for receiving said center beam therein; and two side beams connecting said respective side arms of said end beams, wherein said first channel includes two side beam channels each comprising means for receiving one of said side beams therein.

31. The subassembly defined by claim 30, wherein each said support post comprises a convex face and is made of unidirectional glass fibers in a thermosetting plastic covered by a thermoplastic outer coating.

32. The subassembly defined by claim 25, wherein said first key is shaped to block entry of said first support post into said sleeve when rotated to position said first lock to its unlocked position.

33. The subassembly defined by claim 15, wherein said first end beam has a second hole and a second slot spaced from the first hole and the first slot, wherein the second slot opens at one end into the second hole and at the opposite end onto an exterior surface of said first end beam, and wherein said subassembly further comprises:

a second lock formed to be disposed in the second hole and to be moved between locked and unlocked positions; and a collar comprising first and second tongues each shaped to be received in said first and second slots, respectively, said first and second locks operating to lock and unlock said first and second tongues in the locked and unlocked positions, respectively.

34. The subassembly defined by claim 33, wherein said collar further comprises a main substantially V-shaped body, wherein said first and second tongues each have an opening therein for receiving a portion of said first and second locks, respectively, in the locked position and for permitting withdrawal of said portions of said first and second locks, respectively, when said first and second locks are moved from the locked to the unlocked positions, and wherein said first and second tongues extend from different ends of said main body in parallel to each other.

35. The subassembly defined by claim 15, further comprising:

a first key button for moving said first lock between its locked and unlocked positions, said first key button comprising:

a head having a size preventing entry into the first hole; and a stem received in said first hole and engaging a portion of said first lock to move said first lock between its locked and unlocked positions.

36. The subassembly defined by claim 35, wherein first end beam has a lateral edge, wherein said head is shaped to extend beyond the lateral edge of said first end beam when said stem is inserted into said first hole and said first key button moves said first lock to its unlocked position, and wherein said head is shaped to lie within the lateral edge of said first end beam when said stem is inserted into the first hole and said first key button moves said first lock to its locked position.

37. A subassembly of a frame system, comprising:

an end beam; and a collar formed to be attached to said first end beam to form a sleeve therewith for wedging a support element therein, wherein one of said collar and said end beam has a first hole therein and a first slot opening into the first hole and onto an exterior surface of said one of said collar and said end beam, wherein the other of said collar and said end beam has a tongue formed to be received in said first slot to enter the first hole, wherein said tongue has an opening therein positioned to pass through the first slot and enter said first hole when said tongue is completely inserted into the first slot.

38. The subassembly defined by claim 37, further comprising a lock received in and movable in the said first hole between locked and unlocked positions for locking and unlocking said tongue, respectively, thereby to lock said collar to said end beam.

39. The subassembly defined by claim 38, wherein said lock comprises a lock tongue formed to extend through the opening in said collar tongue, and wherein said lock tongue is spaced from the opening in said collar tongue when said lock is in the unlocked position.

40. The subassembly defined by claim 39, wherein said lock is shaped to rotate in said hole between its locked and unlocked positions.

41. The subassembly defined in claim 37, wherein one of said collar and said end beam has a second hole and a second slot opening into said second hole and onto said exterior surface, wherein the other of said end beam and said collar has two arms in a substantially V-shaped configuration and a second tongue, wherein said first and second tongues extend from different arms substantially in parallel to each other, and wherein the distance between said first and second slots is substantially equal to the distance between said first and second tongues.

42. The subassembly defined by claim 37, further comprising a post and a wedge mountable on said post for wedging said post in a sleeve formed by said end beam and said collar.

43. A subassembly for a frame system, comprising:

a hollow plastic support post having a generally right triangular cross-section, two exterior sides, and an interior side longer than said exterior sides, said exterior and interior sides each having an exterior surface, the right angular apex of said right triangular cross-section being defined by said two exterior sides and thereby constituting an exterior apex, and wherein the outer surface of said interior side of said support post is bowed outwardly of said post.

44. The subassembly defined by claim 43, wherein said outer surface of said interior side is convex in shape.

45. The subassembly defined by claim 43, wherein said outer surface of said interior side of said support post deviates from a straight line connecting the ends of said outer surface of said interior side, and wherein the maximum deviation of said outer surface of said interior side from said straight line, in a direction perpendicular to the straight line, is in the range of approximately 0.001 inch–0.1 inch.

46. The subassembly defined by claim 45, wherein said maximum deviation of said outer surface of said interior side, from said straight line, in a direction perpendicular to the straight line, is approximately 0.01 inch.

47. The subassembly defined by claim 43, wherein said support post is composed of pultruded thermosetting plastic having unidirectional fibers extending therethrough.

48. The subassembly defined by claim 47, wherein said thermosetting plastic is thermosetting polyester.

49. The subassembly defined by claim 48, wherein said support post is further composed of a random weave mat within said thermosetting polyester.

50. The subassembly defined by claim 47, further comprising a thermoplastic coating bonded to the outer surface of said thermosetting polyester.

51. The subassembly defined by claim 50, wherein said thermoplastic coating is composed of one of ABS and PET plastic.

52. The subassembly defined by claim 43, wherein each apex of said right triangular cross-section is rounded.

53. The subassembly defined by claim 52, wherein the radius of curvature of each apex is of the order of 0.375 inch, and wherein the distance from each interior angle apex to its opposite side, along a line parallel to the exterior adjacent side, is of the order of 1.457 inch.

54. The subassembly defined by claim 43, wherein said right triangular cross-section is a right equilateral triangular cross-section.

55. The subassembly defined by claim 43, further comprising:

a wedge mounted on said interior side of said support post by a snap-on operation and having a wedge portion;

an end beam having a corner portion for engaging said wedge portion; and a collar for cooperating with said corner portion of said end beam to form a sleeve around said support post, the sleeve having a shape complementary to said support post and wedge, wherein each of said support posts, said wedge, said corner of said end beam, and said collar are symmetrical about a plane passing through the exterior apex and normal to said interior side of said support post.

56. The subassembly defined by claim 43, further comprising a wedge formed to be mounted on said interior side of said support post by a snap-on operation, wherein said interior side of said support post comprises at least one detent step formed thereon, and wherein said wedge is provided with at least one detent tab corresponding to said at least one detent step for locating said wedge at a predetermined position on said support post.

57. The subassembly defined by claim 56, wherein a plurality of detent steps are periodically disposed along the length of said support post at a predetermined interval.

58. The subassembly defined by claim 57, wherein the predetermined interval is ½ inch.

59. A subassembly for a shelving system, comprising:

a support for a mat;

a post having a generally right triangular cross-section, two exterior faces, and an interior face;

a wedge for coupling the interior face of said post to said support, wherein said wedge is shaped to be snapped onto the interior face of said post and is formed to receive the weight of a shelf from said support by wedging action of said wedge between said support and said post; and means for causing the interior face of said post to be urged in the outward direction relative to said post against said wedge in response to the weight of the shelf being communicated to said post by wedging action of said wedge.

60. The subassembly defined by claim 59, wherein said interior face displacing means comprises an inner convex surface of said interior face of said post.

61. A subassembly for a shelving system, comprising:

a hollow thermosetting support post having a generally right triangular cross-section defining an exterior surface and having two exterior sides and an interior side; and a thermoplastic coating bonded to the exterior surface of said support post, wherein said thermoplastic coating on the interior face of said support post has at least one detent step formed therein, wherein said detent step has a depth less than the depth of said thermoplastic coating.

62. The subassembly defined by claim 61, wherein a plurality of detent steps are disposed periodically along the length of said support post in said thermoplastic coating on the interior side of said support post, each said detent step having a depth less than the depth of said thermoplastic coating.

63. The subassembly defined by claim 62, further comprising a wedge formed to be mounted on the interior side of said support post by a snap-on operation and comprising at least one detent tab corresponding to said at least one detent step for locating said wedge at a predetermined position on said support post.

64. The subassembly defined by claim 61, wherein said post is composed of a thermosetting polyester, and wherein said thermoplastic coating is one of an ABS and PET coating.

65. The subassembly defined by claim 61, wherein said interior side has a plurality of sequentially identified detent steps thereon, wherein said wedge has a window for viewing the interior side of said support post, whereby the detent steps can be viewed through the window.

* * * * *

UNITED STATES PATENT AND TRADEMARK OFFICE

CERTIFICATE OF CORRECTION

PATENT NO. : 5,271,337

DATED : December 21, 1993

INVENTORS : ALBERT KOLVITES, ET AL.

It is certified that error appears in the above-identified patent and that said Letters Patent is hereby corrected as shown below:

COLUMN 7

Line 63, "66," should read --166,--.

COLUMN 14

Line 41, "Cylinder 80" should read --cylinder 80--.

COLUMN 16

Line 64, "is to be post." should read --is to be put.--.

COLUMN 17

Line 25, "on" should read --in--.

COLUMN 18

Line 2, "associate" should read --associated--.

COLUMN 19

Line 27, "plane" should read --lateral plane--.
Line 50, "slot said" should read --slot, said--.

UNITED STATES PATENT AND TRADEMARK OFFICE

CERTIFICATE OF CORRECTION

PATENT NO. : 5,271,337

DATED : December 21, 1993

INVENTORS : ALBERT KOLVITES, ET AL.

It is certified that error appears in the above-identified patent and that said Letters Patent is hereby corrected as shown below:

COLUMN 20

Line 54, "plastic" should read --plastic,--.

COLUMN 21

Line 64, "first" should read --said first--.

Signed and Sealed this

Twenty-second Day of August, 1995

*Attest:*

*Attesting Officer*

BRUCE LEHMAN

*Commissioner of Patents and Trademarks*